US011332330B2

(12) United States Patent
Taba

(10) Patent No.: US 11,332,330 B2
(45) Date of Patent: May 17, 2022

(54) SHEET FEEDING APPARATUS AND IMAGE FORMING APPARATUS

(71) Applicant: CANON KABUSHIKI KAISHA, Tokyo (JP)

(72) Inventor: Yasuzumi Taba, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 202 days.

(21) Appl. No.: 16/659,930

(22) Filed: Oct. 22, 2019

(65) Prior Publication Data

US 2020/0148490 A1 May 14, 2020

(30) Foreign Application Priority Data

Nov. 14, 2018 (JP) ..... JP2018-214208

(51) Int. Cl.
*B65H 1/14* (2006.01)
*B65H 7/02* (2006.01)

(52) U.S. Cl.
CPC ..... *B65H 1/14* (2013.01); *B65H 7/02* (2013.01); *B65H 2405/10* (2013.01); *B65H 2801/06* (2013.01)

(58) Field of Classification Search
CPC ... B65H 1/04; B65H 1/14; B65H 7/02; B65H 7/04; B65H 7/14; B65H 2405/00; B65H 2405/10; B65H 2405/311; B65H 2601/26; B65H 2407/50
See application file for complete search history.

(56) References Cited

U.S. PATENT DOCUMENTS

| | | | | |
|---|---|---|---|---|
| 7,922,171 | B2 | 4/2011 | Kawamura et al. | |
| 8,297,613 | B2 | 10/2012 | Katayama | |
| RE44,947 | E | 6/2014 | Kawamura et al. | |
| 2011/0140356 | A1* | 6/2011 | Katayama | B65H 7/02 271/265.01 |
| 2016/0297631 | A1* | 10/2016 | Okazaki | G03G 15/6502 |

FOREIGN PATENT DOCUMENTS

| | | | |
|---|---|---|---|
| JP | 2006-008404 | A | 1/2006 |
| JP | 2011-121723 | A | 6/2011 |
| JP | 2011126100 | A * | 6/2011 |
| JP | 2014-177353 | A | 9/2014 |
| JP | 2017197235 | A * | 11/2017 |

* cited by examiner

*Primary Examiner* — Howard J Sanders
(74) *Attorney, Agent, or Firm* — Venable LLP

(57) ABSTRACT

A sheet feeding apparatus includes a first detection device that outputs a first signal upon detecting a stacked sheet and outputs a second signal upon detecting no sheet, and a second detection device that outputs a third signal when a sheet stacking member is above a predetermined position and outputs a fourth signal in a case where the stacking member is below the predetermined position A control unit controls movement of sheet stacking member by restricting movement of the stacking member when the second signal is output and the third signal is output when power of the sheet feeding apparatus is turned on. The second detection device includes a switch that emits the third signal while abutting a moving member that moves with the sheet stacking member and emits the fourth signal while being separated from the moving member.

20 Claims, 18 Drawing Sheets

SHEET FEEDING APPARATUS AND IMAGE FORMING APPARATUS

BACKGROUND OF THE INVENTION

Field of the Invention

This disclosure relates to a sheet feeding apparatus that feeds a sheet and an image forming apparatus that forms an image on the sheet.

Description of the Related Art

Some sheet feeding apparatuses used in an image forming apparatus include a vertically movable tray on which sheets are stacked and a feed roller for feeding the sheets on the tray. As a lifting mechanism for lifting the tray up and down, there are a mechanism for winding a wire hanging the tray by a drive force of a motor and a mechanism for pivoting an arm member supporting the lower surface of the tray by a motor. In such a sheet feeding apparatus, there is a case where a packing member for restricting the movement of the tray is mounted in order to prevent the tray from being inadvertently moved and damaging the apparatus during transportation.

However, if the power of the sheet feeding apparatus is turned on while the packing member remains inside the sheet feeding apparatus and the tray lifting operation is performed, there is a possibility that a large load is applied to the tray and the lifting mechanism, resulting in damage. In a Japanese Patent Laid-open No. 2011-121723, it is configured such that by disposing a part of the packaging member in contact with a sheet surface detection sensor and the packing member so as not to contact a sheet presence detection sensor, a control unit determines that there is no sheet in a case where the packing member is mounted. Then, by displaying a message notifying the sheet absence state on a display unit of the image forming apparatus, a user is made aware of the presence of the packing member and prevents the tray from performing the lifting operation while the packing member is mounted.

However, in the configuration of the above document, a part of the packing member is in contact with the sheet surface detection sensor in the vicinity of the position where the feed roller abuts on the sheet. Therefore, for example, if the packing member scratches the surface of the sheet surface detection sensor facing the sheet due to vibration during transportation, the sheet may be caught by the scratch and a feeding failure may occur. Since a part of the packing member extends to the same height as the feed roller, the packing member may come into contact with another member when the tray is pulled out.

SUMMARY OF THE INVENTION

The present invention provides a sheet feeding apparatus and an image forming apparatus which can prevent forgetting to remove a packing member and avoid the packing member interfering with surrounding members.

According to one aspect of the invention, a sheet feeding apparatus includes: a storage portion configured to store a sheet and including a stacking member on which the sheet is stacked; a sheet feeding unit disposed above the stacking member and configured to feed the sheet stacked on the stacking member; a lifting unit configured to lift the stacking member; a first detection device configured to output a first signal upon detecting the sheet stacked on the stacking member and to output a second signal upon detecting no sheet; a second detection device configured to output a third signal in a case where the stacking member is above a predetermined position and to output a fourth signal in a case where the stacking member is below the predetermined position, the predetermined position being lower than a position at which the sheet feeding unit abuts on the sheet stacked on the stacking member; a packing member detachably attached to the storage portion; a regulation member configured to regulate a state of the second detection device such that the second detection device outputs the third signal in a state in which the stacking member is below the predetermined position, the regulation member being configured to be removed from the sheet feeding apparatus in a case where the packing member is detached; and a control unit configured to control movement of the stacking member by the lifting unit, the control unit being configured to restrict the movement of the stacking member in a case where the first detection device outputs the second signal and the second detection device outputs the third signal when power of the sheet feeding apparatus is turned on.

Further features of the present invention will become apparent from the following description of exemplary embodiments with reference to the attached drawings.

DESCRIPTION OF THE EMBODIMENTS

Hereinafter, exemplary embodiments of the invention will be described with reference to the drawings.

First Embodiment

Figure 1:
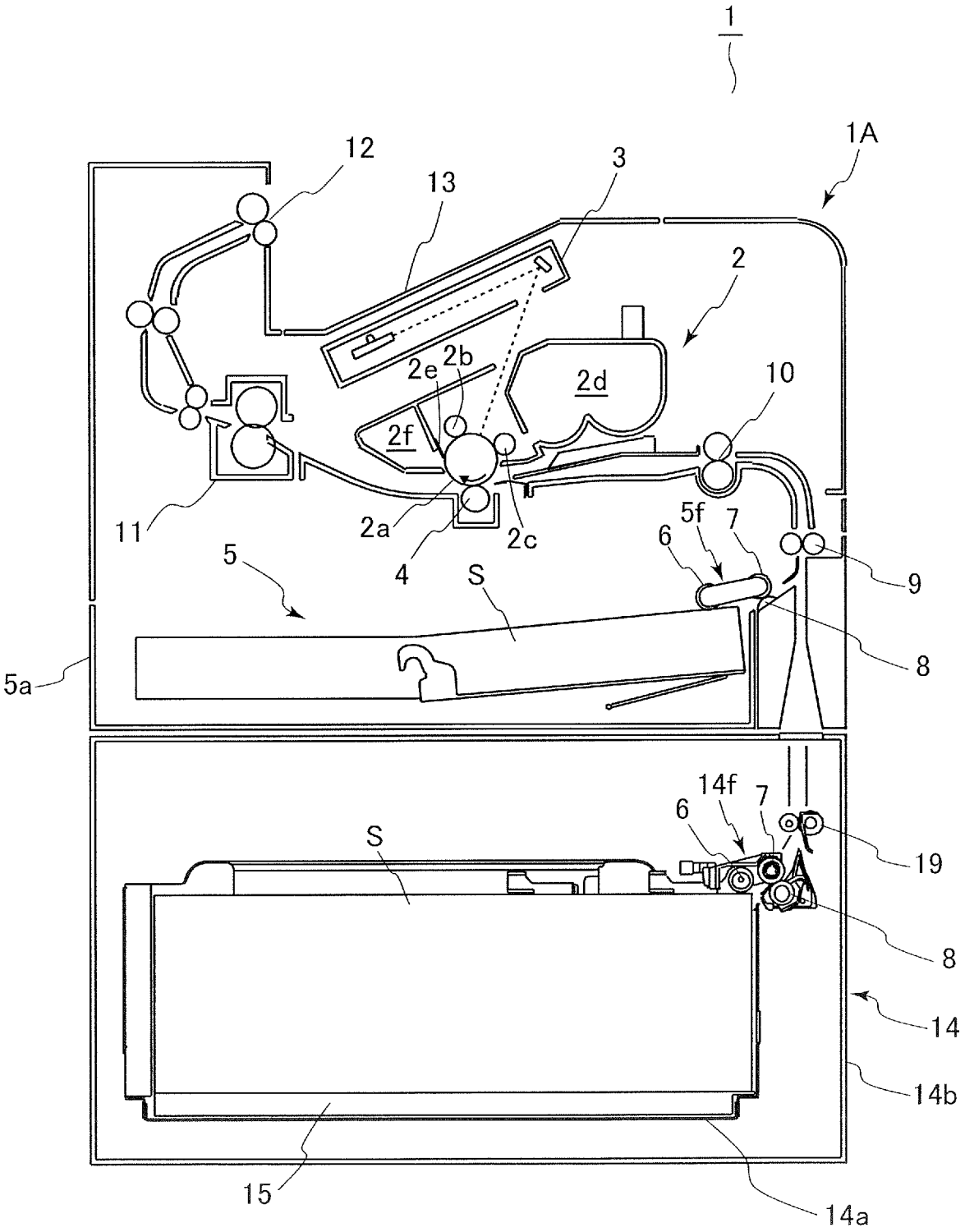
FIG. 1 is a schematic view of an image forming apparatus according to a first embodiment.

FIG. 1 is a schematic view illustrating a laser beam printer of an electrophotographic system (hereinafter, referred to as printer 1) that forms a monochrome toner image, which is an image forming apparatus of a first embodiment. The printer 1 includes a sheet feeding deck 14 and a printer body 1A having an image forming unit 2 and connected to the upper side of the sheet feeding deck 14.

When an image formation command is input to the printer 1, the image forming unit 2 executes an image forming process of the electrophotographic system. That is, a charge roller 2*b* charges a surface of a photosensitive drum 2*a* serving as an image bearing member, and the photosensitive drum 2*a* is irradiated with a laser beam, which is modulated based on image data to be printed by a laser scanner 3, and an electrostatic latent image is written on the drum surface. A developing roller 2*c* supplies charged toner particles to the photosensitive drum 2*a* and develops the electrostatic latent image into a toner image. The toner consumed by development is replenished from a toner container 2*d*.

In parallel with the image forming process, a sheet S is fed from a sheet feeding unit 5 provided in the printer body 1A or from the sheet feeding deck 14. A sheet feed unit 5*f* of the sheet feeding unit 5 feeds the sheet S stacked in a cassette 5*a* mounted on the printer body 1A. A sheet feed unit 14*f* of the sheet feeding deck 14 feeds the sheet S stored in a deck portion 14*a* of the sheet feeding deck 14. Each of the sheet feed units 5*f* and 14*f* has a pickup roller 6, a feed roller 7, and a separating roller 8. The sheet S fed from the cassette 5*a* or the deck portion 14*a* by the pickup roller 6 is separated and conveyed one by one by the feed roller 7 and the separating roller 8.

The separating roller 8 is provided with a torque limiter therein. The limit value of the torque limiter is set so that when one sheet is conveyed to a separation nip formed by the feed roller 7 and the separating roller 8, the separating roller 8 is driven and rotated by the feed roller 7. On the other hand, when a plurality of sheets are conveyed to the separation nip, the separating roller 8 stops regardless of rotation of the feed roller 7. It is noted that driving may be input to the separating roller 8 so that such sheet is pushed back in a direction opposite to the sheet conveyance direction by the feed roller 7.

The sheet S fed from the sheet feeding unit 5 or the sheet feeding deck 14 is conveyed via a conveyance roller pair 9 and 19 and is brought into contact with a registration roller pair 10 in a stopped state, so that skew correction is performed. The registration roller pair 10 feeds the sheet S to a transfer unit between the photosensitive drum 2*a* and a transfer roller 4 at a timing synchronized with the image forming process by the image forming unit 2. Then, the toner image is transferred from the photosensitive drum 2*a* to the sheet S by applying a bias voltage to the transfer roller 4. Deposits such as residual toner remaining on the drum are removed by a cleaning blade 2*e* and collected in a waste toner container 2*f*.

The sheet S on which the toner image is transferred is conveyed to a fixing unit 11. The fixing unit 11 applies heat and pressure to the toner image on the sheet while nipping and conveying the sheet S by a heating roller and a pressing roller. Accordingly, the toner is melted and then fixed, so that the image is fixed on the sheet S. The sheet S passed through the fixing unit 11 is discharged to a sheet discharge tray 13 by a sheet discharge roller pair 12.

The image forming unit 2 is an example of an image forming unit, and may be replaced by an intermediate transfer type electrophotographic unit that transfers the toner image formed on an image bearing member to a sheet via an intermediate transfer body such as an intermediate transfer belt. In addition, an image forming unit other than an electrophotography such as an inkjet printing method or an offset printing method may be used as the image forming unit.

Sheet Feeding Deck

Figure 2:
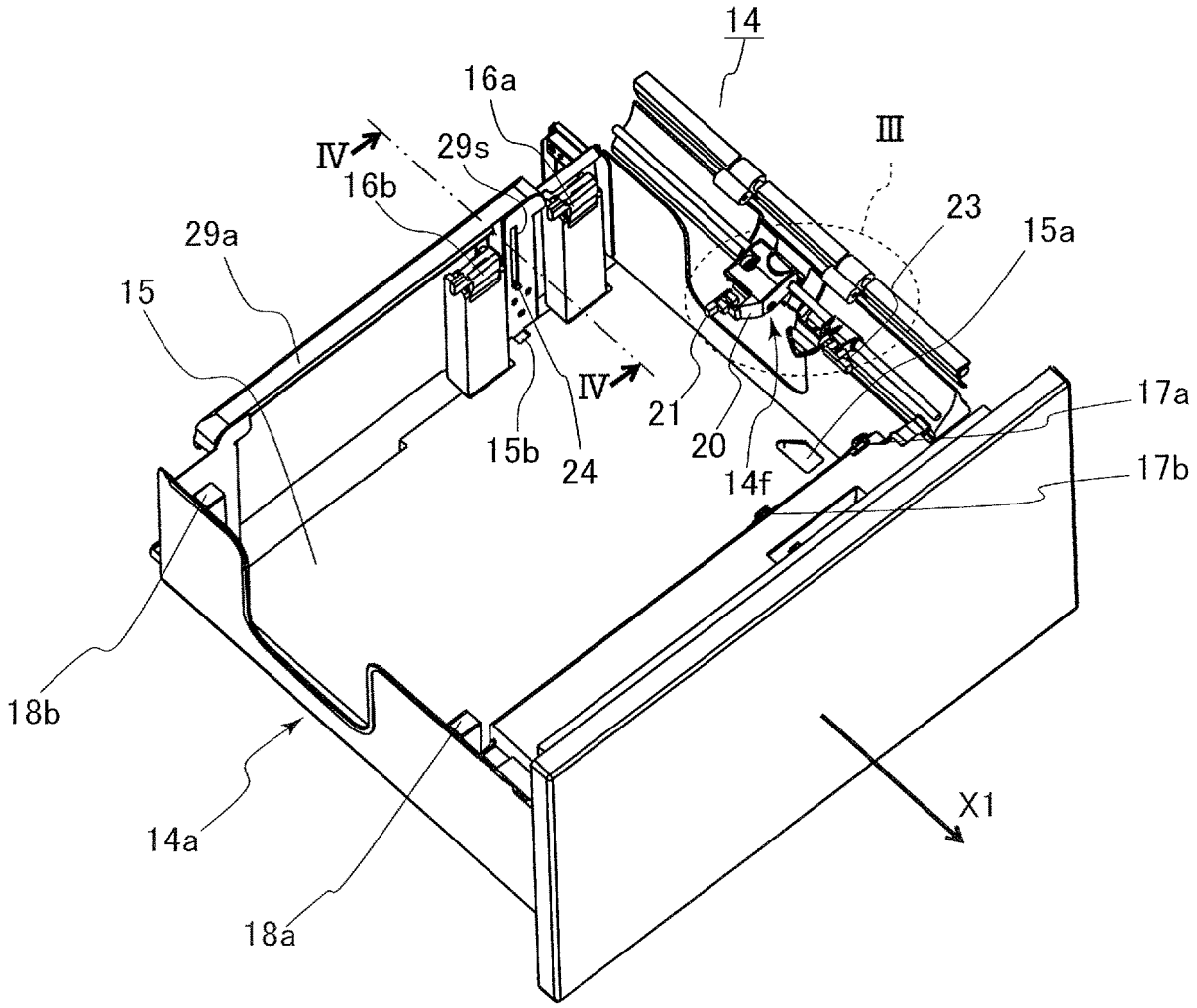
FIG. 2 is a perspective view illustrating inside of a sheet feeding deck according to the first embodiment.

Next, the sheet feeding deck 14 will be described. FIG. 2 is a perspective view illustrating a state in which the deck portion 14*a* of the sheet feeding deck 14 is pulled out from a casing 14*b* (FIG. 1). The deck portion 14*a* is supported by the casing 14*b* via a slide rail and is drawable (i.e., can be pulled out) from the casing 14*b* in a predetermined pulling direction X1 (front direction of printer 1 in the present embodiment). A tray 15 on which sheets are stacked is disposed inside the deck portion 14*a*. The tray 15 is a stacking member of the present embodiment, and the deck portion 14*a* is a storage portion of the present embodiment. The position of the sheets stacked on the tray 15 is regulated by side regulation members 16*a*, 16*b*, 17*a*, and 17*b* and trailing edge regulation members 18*a* and 18*b*. That is, the side regulation members 16*a*, 16*b*, 17*a*, and 17*b* are in contact with the end portion of the sheet in the width direction of the sheet (direction perpendicular to sheet feeding direction by sheet feed unit 14*f*) and the trailing edge regulation members 18*a* and 18*b* are in contact with a trailing edge of the sheet (upstream edge in sheet feeding direction).

The sheet feeding deck 14 is provided with a sheet surface sensor 21 and a sheet presence sensor 23 as detection units for detecting the state of the apparatus. The sheet presence sensor 23 is a first detection device of the present embodiment and the sheet surface sensor 21 is a third detection device of the present embodiment. The sheet surface sensor 21 is a sensor that detects that the upper surface of the sheet stacked on the tray 15 is at a height where the sheet can be fed by the sheet feed unit 14*f*, and is used to maintain the position of the uppermost sheet within a range suitable for feeding. The sheet presence sensor 23 is a sensor that detects presence or absence of the sheets stacked on the tray 15.

Figure 3:
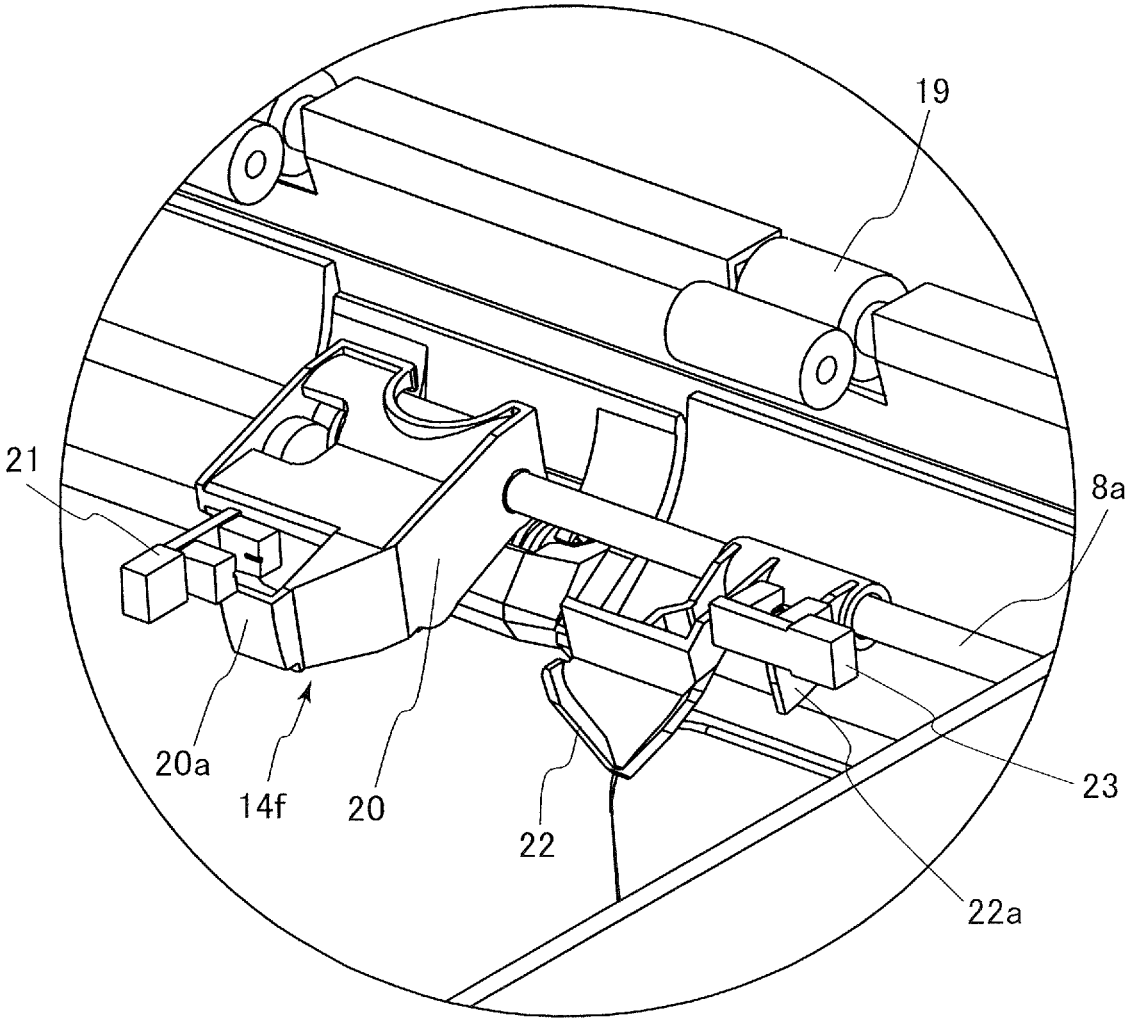
FIG. 3 is an enlarged view of a part of FIG. 2.

FIG. 3 is an enlarged view of a portion surrounded by a broken line in FIG. 2. The pickup roller of the sheet feed unit 14*f* is rotatably held by a holder 20 which is a holding member. The holder 20 vertically pivots around a roller shaft 8*a* of the feed roller. The sheet surface sensor 21 of the present embodiment uses a photoelectric sensor that includes a light emitting portion and a photosensing portion and is shielded by a flag 20*a* provided at a distal end portion of the holder 20. That is, in a case where the sheets stacked on the tray 15 are not in contact with the pickup roller, the photosensing portion of the sensor is not shielded (on state), and the sheet surface sensor 21 outputs an on signal as a sixth signal. On the other hand, in a case where the pickup roller comes into contact with the sheets and the holder 20 is pushed upward, the photosensing portion is shielded (off state) by the flag 20*a* at a shielding position, and the sheet surface sensor 21 outputs an off signal as a fifth signal.

Moreover, the sheet presence sensor 23 of the present embodiment uses another photoelectric sensor that includes a light emitting portion and a photosensing portion and is shielded from light by a flag 22*a* of a sheet detection lever 22. The sheet detection lever 22 is a first moving member that is supported by the roller shaft 8*a* and is pivotable independently of the holder 20 of the sheet feed unit 14*f*. In a case where the sheets stacked on the tray 15 are not in contact with the sheet detection lever 22, the photosensing portion of the sensor is not shielded (on state) by the sheet detection lever 22 below a shielding position, and the sheet presence sensor 23 outputs an on signal as a second signal. On the other hand, in a case where the sheet comes into contact with the sheet detection lever 22 and the flag 22*a* rotates vertically upward, the photosensing portion is shielded (off state) by the sheet detection lever 22 at the shielding position, and the sheet presence sensor 23 outputs an off signal as a first signal.

Here, as illustrated in FIG. 2, an opening 15*a* is formed at a position corresponding to the sheet detection lever 22 of the tray 15. Therefore, in a state where no sheet is stacked on the tray 15, even if the tray 15 is raised, the sheet detection lever 22 enters the opening 15*a* and does not pivot, and the output of the sheet presence sensor 23 does not change from on to off. On the other hand, no opening is provided at a position corresponding to the flag 20*a* of the holder 20. Therefore, even when the sheets are not stacked, the output of the sheet surface sensor 21 changes from on to off when the tray 15 is raised to a predetermined height.

Figure 4:
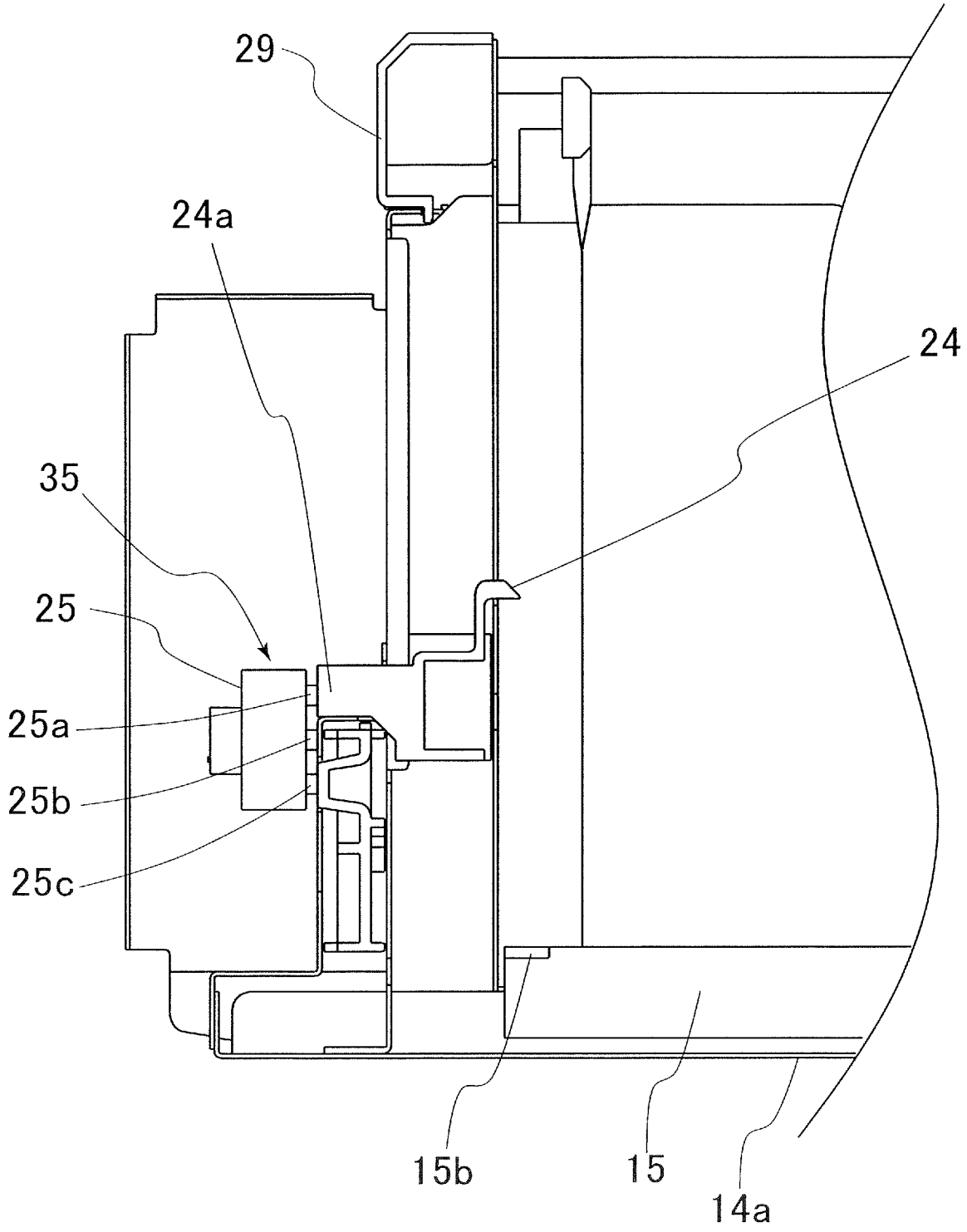
FIG. 4 is a sectional view of the sheet feeding deck at a cutting position illustrated in FIG. 2.

In the sheet feeding deck 14, a tray position detection unit (second detection device in the present embodiment) is provided as a detection unit for acquiring information on the position of the tray 15 in order to calculate the remaining amount of the sheets. FIG. 4 is a sectional view of the sheet feeding deck 14 at a cutting position illustrated in FIG. 2. A tray position detection unit 35 includes a tray position detection switch 25*a* in a triple switch 25 installed in the deck portion 14*a* and a tray detection flag 24 which is a second moving member movable in conjunction with the tray 15.

As illustrated in FIGS. 2 and 4, the tray detection flag 24 protrudes above the tray 15 through a slit 29*s* formed in a back frame 29*a* of the deck portion 14*a*. In a case where the tray 15 is above a predetermined position in the vertical direction, the tray detection flag 24 is raised and lowered with the tray 15 while being in contact with a contact portion 15*b* of the tray 15. In a case where the tray 15 is below the predetermined position, the tray detection flag 24 is separated from the contact portion 15*b* and stops in a state where it is in contact with the lower end portion of the slit 29*s*.

The tray position detection switch 25*a* is disposed such that in a case where the tray detection flag 24 is at the lower end position of the slit 29*s*, the switch is activated by being pressed by a projection portion 24*a* of the tray detection flag 24. That is, the tray position detection switch 25*a* is configured such that the output signal changes depending on whether or not the tray 15 is above a predetermined position in the vertical direction. As described below, in the present embodiment, the position of the tray 15 when the output signal of the tray position detection switch 25*a* changes is treated as a reference position for obtaining the remaining amount of the sheet stored in the sheet feeding deck 14. Therefore, in the following description, the position at which the output signal of the tray position detection switch 25*a* switches is referred to as the "reference position" of the tray 15.

It is noted that a second switch 25*b* of the triple switch 25 detects whether or not the deck portion 14*a* is inserted at a predetermined position with respect to the casing 14*b* of the sheet feeding deck 14. That is, the control unit can acquire the opened and closed state of the deck portion 14*a* based on the output signal of the switch 25*b*. A third switch 25*c* is used to determine the size of the sheet stacked on the tray 15. That is, the output signal of the switch 25*c* changes depending on the position of the side regulation members 16*a*, 16*b*, 17*a*, and 17*b*, and it is possible to determine, for example, whether an A4 size or a Letter size sheet is stored from the output signal of the switch 25*c*.

Figure 5:
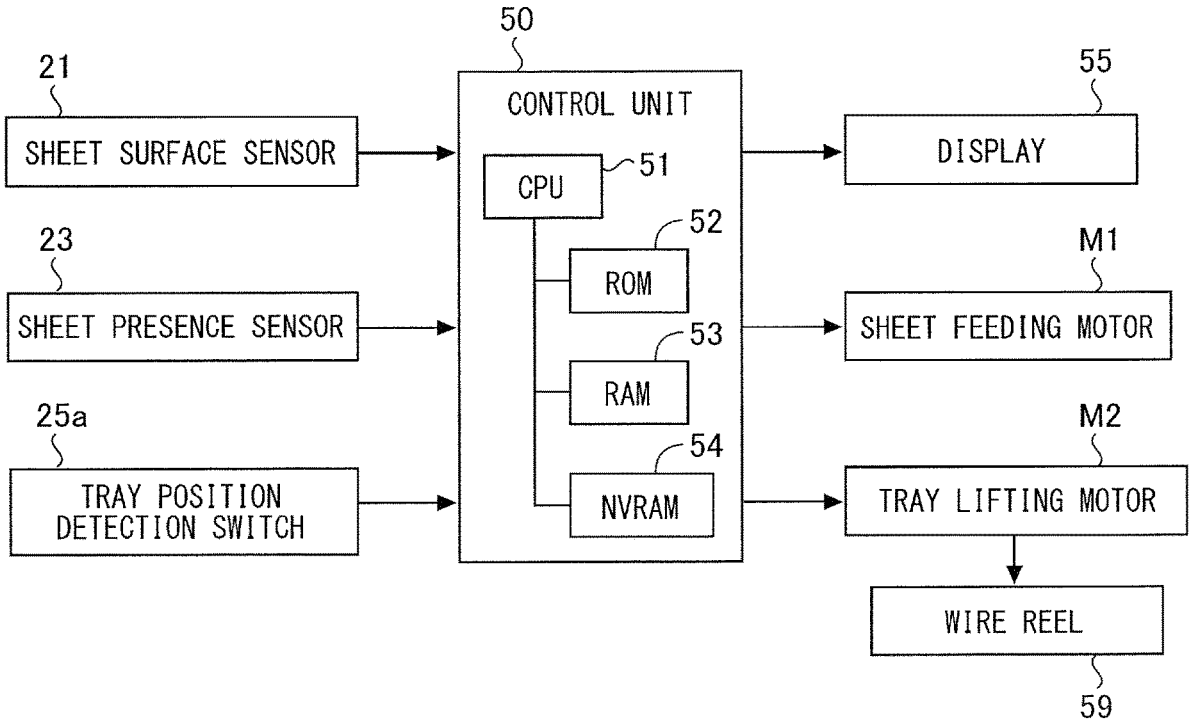
FIG. 5 is a block diagram illustrating a control system of a printer according to the first embodiment.

FIG. 5 is a block diagram illustrating a control system of the printer 1. A control unit 50 is a control board on which a central processing unit (CPU) 51, a read only memory (ROM) 52, a random access memory (RAM) 53, and a nonvolatile RAM (NVRAM) 54 are mounted, and is mounted on the printer body 1A. The CPU 51 reads and executes a control program stored in a non-transitory storage medium such as the ROM 52 and controls the operation of the entire printer 1 including the sheet feeding deck 14. The RAM 53 provides a work space when the CPU 51 executes the program. The NVRAM 54 stores data used for control by the CPU 51 and holds the data even in a case where the power of the printer 1 is turned on or off. It is noted that the NVRAM 54 is an example of a nonvolatile storage device that can rewrite store contents and may realize the functions of the NVRAM 54 described below using, for example, an EEPROM or an SSD.

The control unit 50 is connected to a display 55 which is a user interface of the printer 1. The display 55 includes a display panel as a display unit for displaying information to the user. The CPU 51 sends a command signal to the display 55 to display information such as the current of the printer 1 (for example, remaining amount of sheets in sheet feeding deck 14) and notification to the user (for example, warning message prompting replenishment of sheet). Moreover, the display 55 includes a physical key which accepts a user input operation and a touch panel function of the display, and also functions as an input portion that can input setting information and a print instruction to the printer 1. The information input to the display 55 is transmitted to the control unit 50.

The output signals from the sheet surface sensor 21, the sheet presence sensor 23, and the tray position detection switch 25*a* provided in the sheet feeding deck 14 are input to the control unit 50. The CPU 51 controls the operation of the sheet feeding deck 14 by executing the control program based on these output signals and sending a command for instructing the rotational speed and the rotation amount of a sheet feeding motor M1 and a tray lifting motor M2 to a drive circuit that drives these motors. The sheet feeding motor M1 is a drive source that drives the sheet feed unit 14*f* of the sheet feeding deck 14, and the tray lifting motor M2 is a drive source that drives a lifting mechanism that raises and lowers the tray 15. It is noted that, in the present embodiment, a wire type lifting mechanism is used as a lifting unit, and the tray 15 is hanged by a wire (not illustrated). The tray lifting motor M2 performs the lifting operation of the tray 15 by rotating a wire reel 59 around which the wire is wound and winding and feeding the wire.

It is noted that, in the present embodiment, a stepping motor is used as the tray lifting motor M2. The CPU 51 has a function of measuring a variable (i.e., pulse count) indicating the number of driving steps of the stepping motor. The amount of change in the pulse count of the tray lifting motor M2 corresponds to the moving amount of the tray 15 during lift-up or lift-down.

Calculation of Remaining Amount of Sheet

Figure 6:
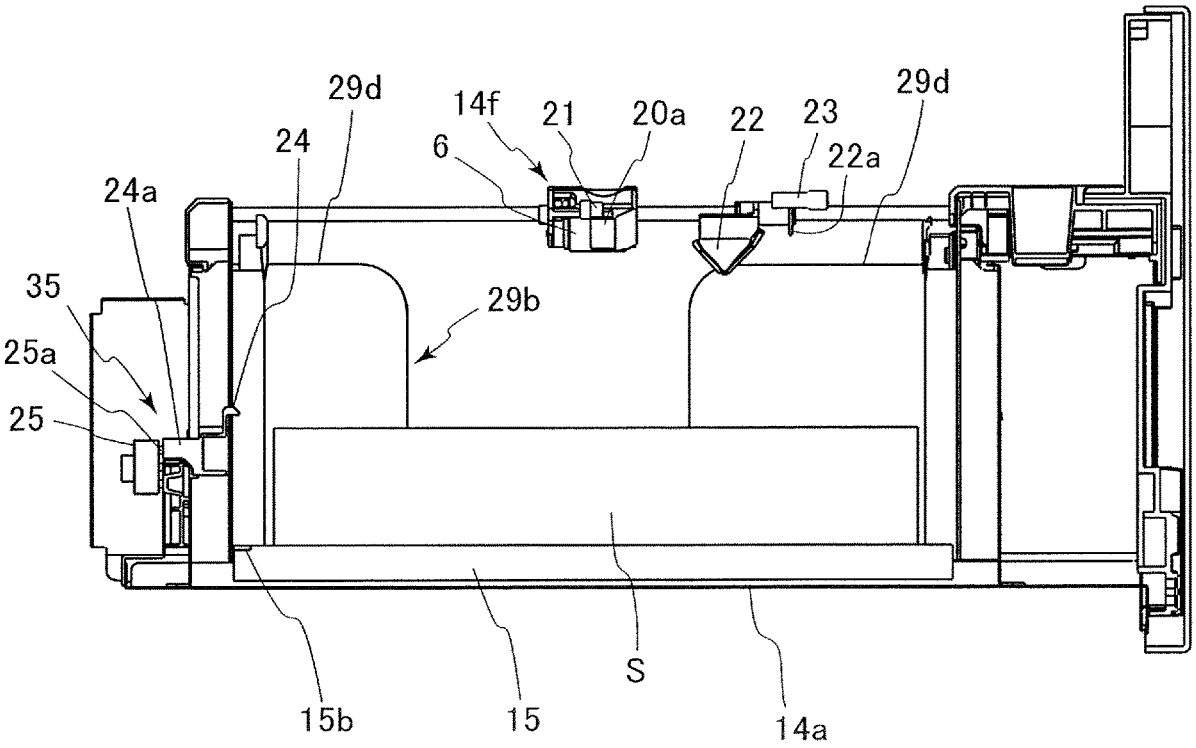
FIG. 6 is a sectional view of the sheet feeding deck according to the first embodiment.

Hereinafter, the calculation method of remaining amount of sheets using the tray position detection switch 25*a* will be described with reference to FIGS. 6 to 8. FIG. 6 illustrates a state right after the deck portion 14*a* is inserted into the casing in a state where the sheets S are stacked on the tray 15. In this case, since the contact portion 15*b* of the tray 15 is in a non-contact state with the tray detection flag 24 and the projection portion 24*a* of the tray detection flag 24 presses the tray position detection switch 25*a*, the output signal of the tray position detection switch 25*a* is on. That is, the tray position detection switch 25*a* outputs a fourth signal indicating that the tray 15 is below the predetermined position. Moreover, the pickup roller 6 and the sheet detection lever 22 are in the non-contact state with the sheet S, and the flags 20*a* and 22*a* do not shield the sheet surface sensor 21 and the sheet presence sensor 23. That is, the output signals of the sheet surface sensor 21 and the sheet presence sensor 23 are both in an on state. When the tray position detection switch 25*a* is in an on state, the CPU 51 initializes the pulse count of the tray lifting motor M2.

When the tray lifting motor rotates according to the instruction from the CPU 51 after the deck portion 14*a* is inserted into the casing, the wire supporting the tray 15 is wound up and the lift-up of the tray 15 starts. FIG. 7 illustrates a state in which the tray 15 is lifted up from the state in FIG. 6, the contact portion 15*b* comes into contact with the tray detection flag 24, and the tray detection flag 24 starts to be raised. Meanwhile, as the tray detection flag 24 is lifted, the projection portion 24*a* is separated from the tray position detection switch 25*a*, and the output signal of the tray position detection switch 25*a* is off. That is, the tray position detection switch 25*a* outputs a third signal indicating that the tray 15 is above the predetermined position. The CPU 51 measures the drive amount of the tray lifting motor M2 with reference to the time when the tray position detection switch 25*a* changes from on to off. That is, the CPU 51 starts measuring the pulse count of the tray lifting motor M2 at the time the tray position detection switch 25*a* changes from on to off.

Figure 7:
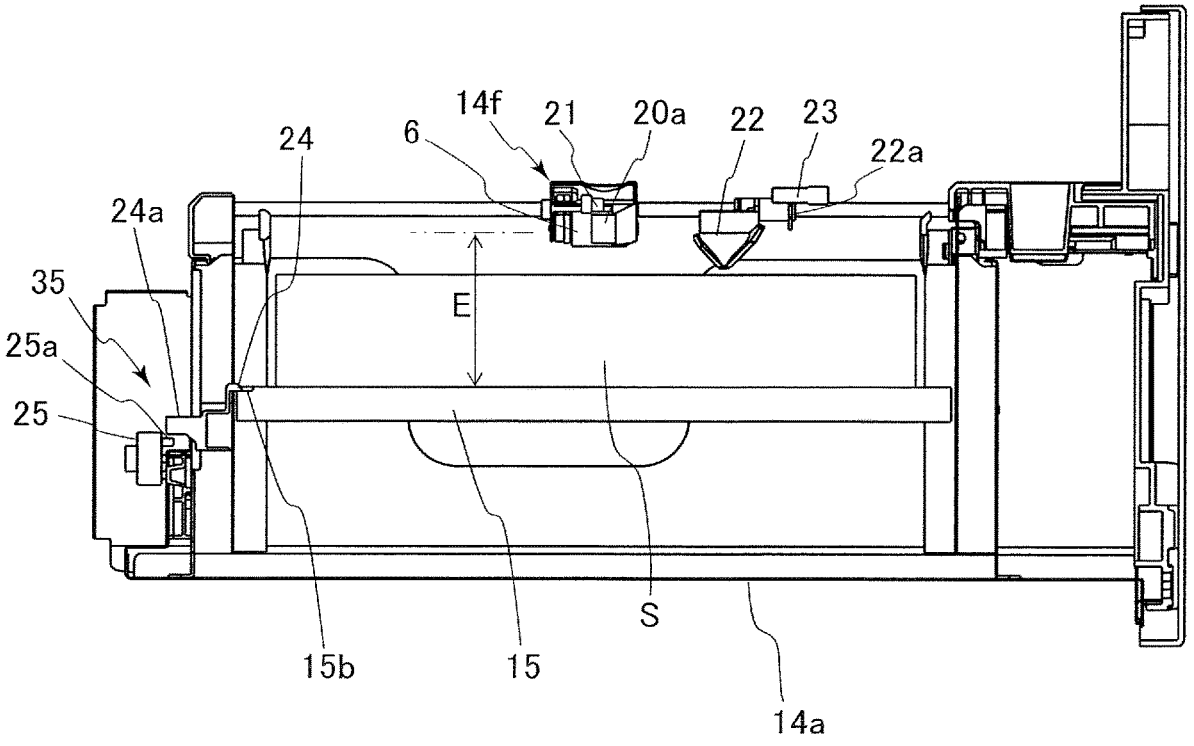
FIG. 7 is a sectional view of the sheet feeding deck according to the first embodiment.
Figure 8:
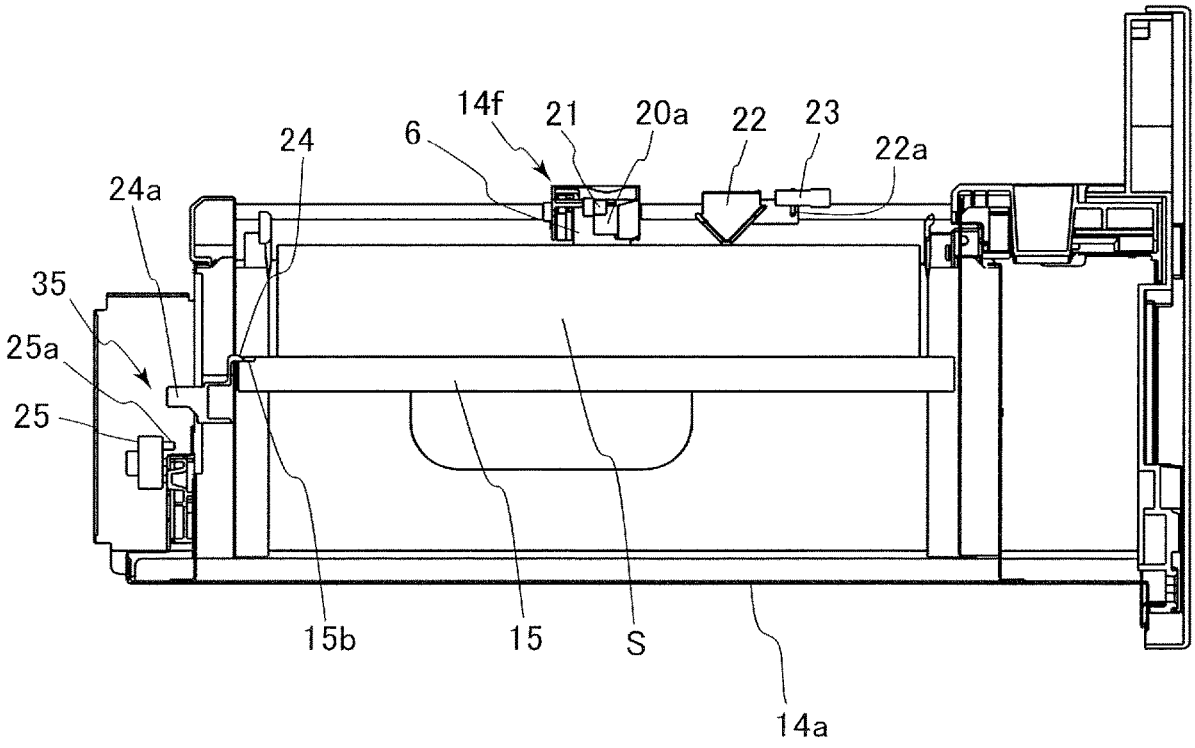
FIG. 8 is a sectional view of the sheet feeding deck according to the first embodiment.

FIG. 8 illustrates a state in which the tray 15 is further lifted up from the state in FIG. 7, the upper surface of the sheet S comes into contact with the pickup roller 6 and the sheet detection lever 22, and the flags 20*a* and 22*a* respectively shield the sheet surface sensor 21 and the sheet presence sensor 23. That is, the output signals of the sheet surface sensor 21 and the sheet presence sensor 23 are both in an off state. When the sheet surface sensor 21 changes from on to off, the tray lifting motor M2 is stopped by the command from the CPU 51, and the pulse count measurement ends. The CPU 51 writes the measured pulse count value in the NVRAM 54.

Here, (i) the tray position when the tray position detection switch 25*a* is switched from on to off and the tray position when the tray 15 on which no sheets are stacked comes into contact with the pickup roller 6, and (ii) the sheet surface sensor 21 is switched from on to off, are both known. The CPU 51 can obtain the remaining amount of the sheet (stacking height of sheet S stacked on tray 15) based on the distance E (FIG. 7) in the vertical direction between the two tray positions and the lift-up amount of the tray 15 calculated from the pulse count of the tray lifting motor.

For example, if the sheet surface sensor 21 is switched from on to off right after the tray position detection switch 25*a* is switched from on to off, it can be determined that the sheets are stacked at substantially the same height as the distance E. Moreover, if the lift-up amount until the sheet surface sensor 21 is switched from on to off is substantially equal to the distance E after the tray position detection switch 25*a* is switched from on to off, it can be determined that the stacking amount of the sheet S is zero or slight. In this case, it can be determined that the stacking amount is zero if the sheet presence sensor 23 is on, and at least one sheet S is stacked if the sheet presence sensor 23 is off. It is noted that when the sheet surface sensor 21 outputs an off signal while the tray position detection switch 25*a* is in the on state, it can be determined that the sheets S are stacked at a height equal to or higher than the distance E.

The CPU 51 notifies the calculated remaining amount of sheets to the display 55, and the display 55 updates the display content of a screen that displays information on the remaining amount of the sheet based on the notified remaining amount of sheets. Examples of "information on the remaining amount of sheets" include an indicator that indicates the remaining amount of sheets gradually changing a part of the image schematically representing the sheet feeding deck 14 and a numerical value showing the ratio of the remaining amount of sheets to the maximum stacking amount.

Packing Member

Figure 9:
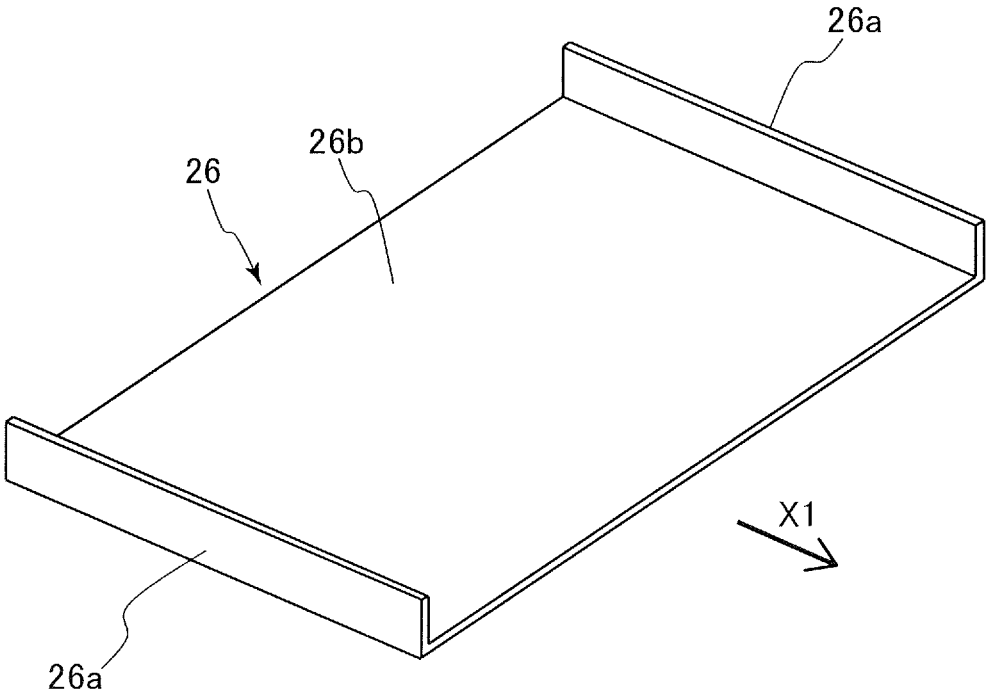
FIG. 9 is a perspective view of a packing member according to the first embodiment.
Figure 10:
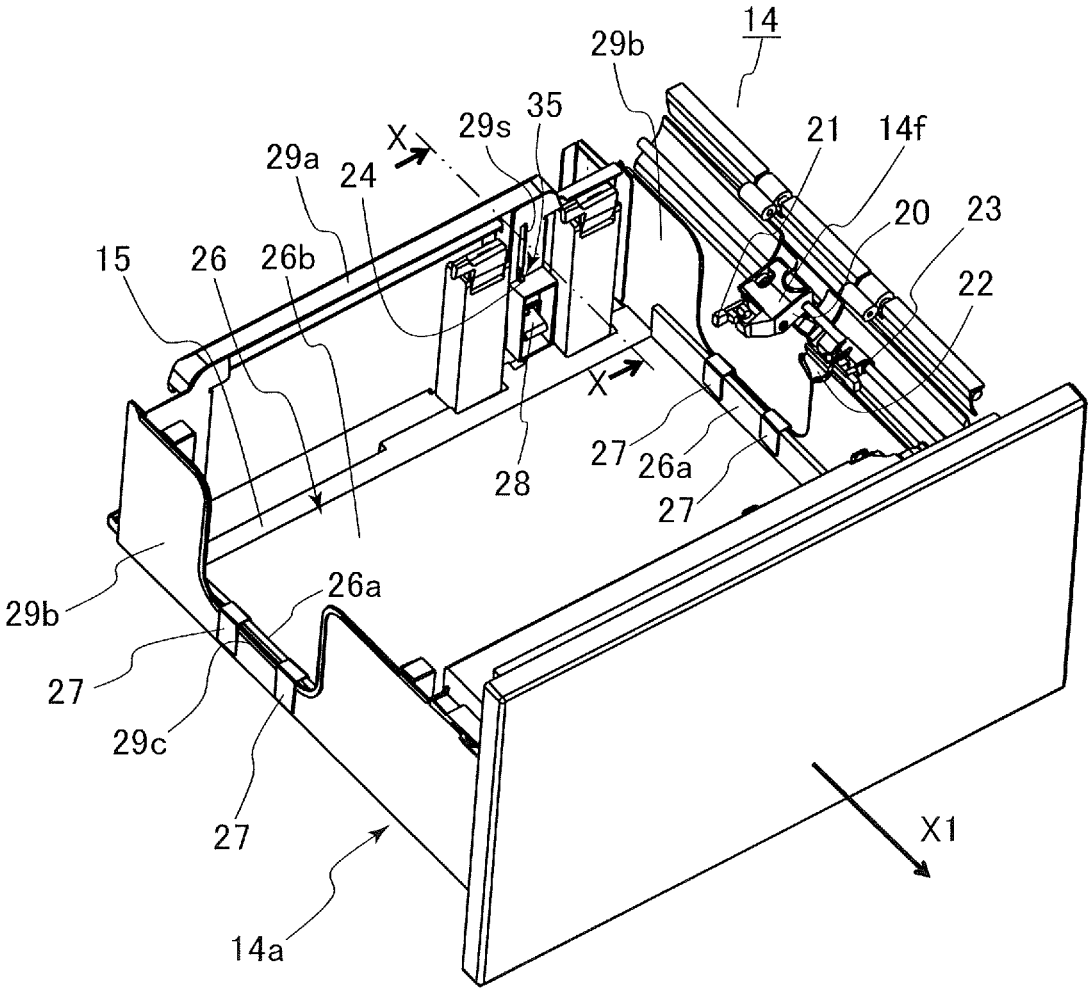
FIG. 10 is a perspective view illustrating a state in which the packing member is mounted on the sheet feeding deck according to the first embodiment.

Next, the packing member mounted on the sheet feeding deck 14 will be described. As illustrated in FIG. 9, a packing member 26 of the present embodiment uses corrugated paper bent in a U-shape (rectangular shape with upper side open in mounted state). As illustrated in FIG. 10, the packing member 26 is fixed to the deck portion 14*a* using a fixing tool such as a tape 27 in a state in contact with the upper surface of the tray 15 at a bottom portion 26*b* and in contact with side frames 29*b* and 29*b* of the deck portion 14*a* at side portions 26*a* and 26*a*. Accordingly, the upper surface of the tray 15 is protected, and the movement of the tray 15 relative to the deck portion 14*a* is restricted. It is noted that not only corrugated paper, but also a bubble cushioning material or a resin sheet may be used as the packing member.

The position of the tray 15 in a state where the packing member 26 is mounted (packed state of sheet feeding deck 14) is set lower than the reference position of the tray 15. In particular, in the present embodiment, the packing member 26 is mounted in a state where the tray 15 is at the lower limit position of the movable range. In the packed state, the packing member 26 is at a position where it does not contact the holder 20 of the sheet detection lever 22 and the sheet feed unit 14*f*, that is, the position separated downward from both the movable range of the sheet detection lever 22 and the movable range of the holder 20. That is, the packing member 26 is disposed so as not to be scratched by contact with the sheet detection lever 22 and the holder 20 due to vibration during transportation. Since the packing member 26 is disposed at a lower position than the deck portion 14*a*, the packing member 26 is prevented from coming into contact with a casing-side member of the sheet feeding deck 14 when the deck portion 14*a* is pulled out.

It is noted that, the side frame 29*b* of the deck portion 14*a* in the present embodiment is provided with a notch portion (cut-out portion) 29*c* with the upper edge portion notched downward, and the side portion 26*a* of the packing member 26 is fixed to the notch portion 29*c* with the tape 27. The height of the notch portion 29*c* is set lower than the reference position of the tray 15, for example. On the other hand, an upper edge portion 29*d* (FIG. 6) of the side frame 29*b* outside the notch portion 29*c* extends to a position substantially the same as the lower end portion of the sheet detection lever 22 and the lower end portion of the holder 20, for example.

Fixing Member

Next, a fixing member 28 which is a regulation member of the present embodiment will be described. As illustrated in FIG. 10, the fixing member 28 is a member that is mounted on the sheet feeding deck 14 with the packing member 26, for example, in a case where the sheet feeding deck 14 is transported. The fixing member 28 has a function of regulating the state of the tray position detection unit 35 so that the tray position detection switch 25*a* outputs an off signal when the power is on in a state where the tray 15 is fixed at a position below the reference position.

Figure 11:
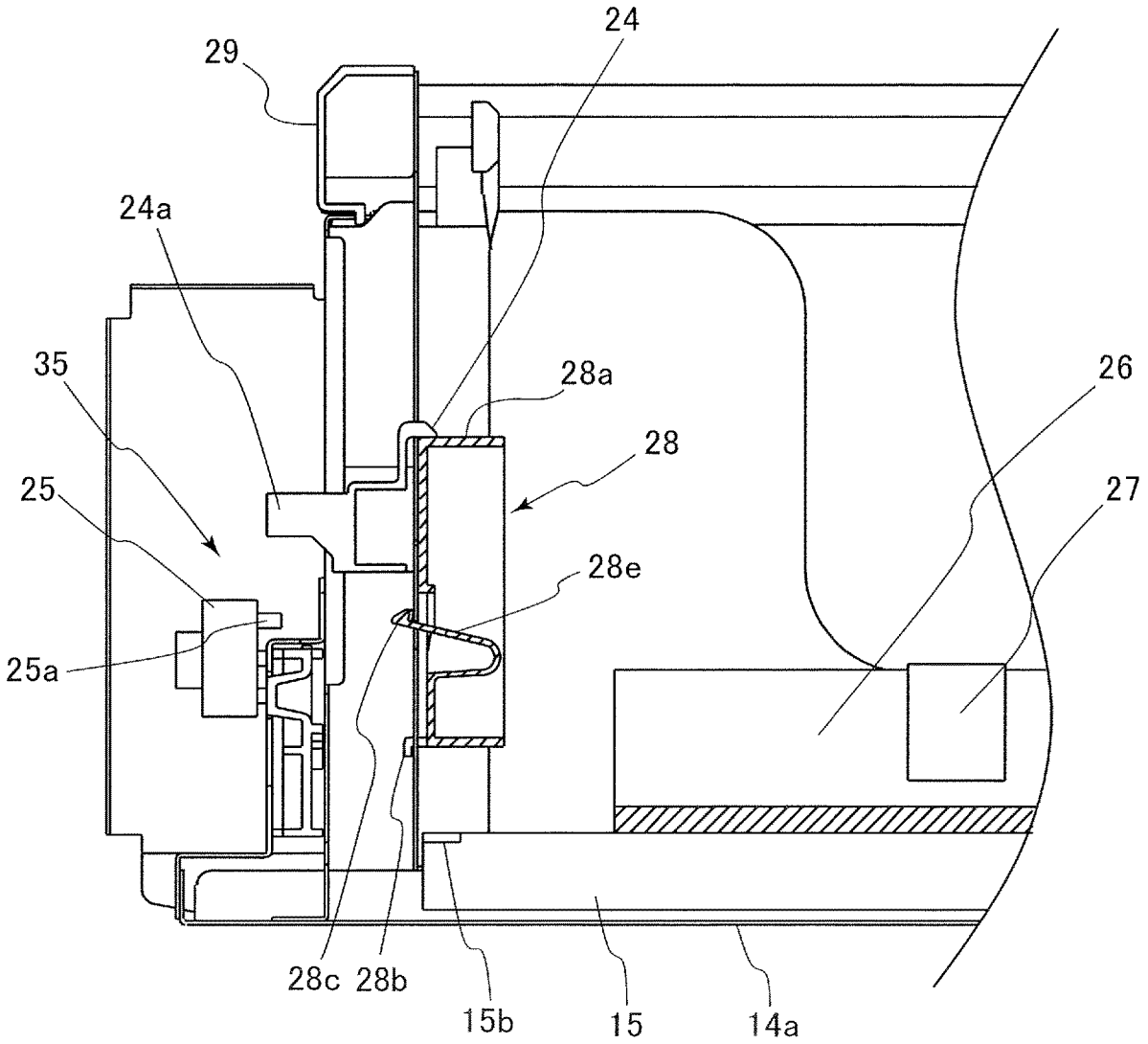
FIG. 11 is a sectional view of the sheet feeding deck at the cutting position illustrated in FIG. 10.
Figure 12:
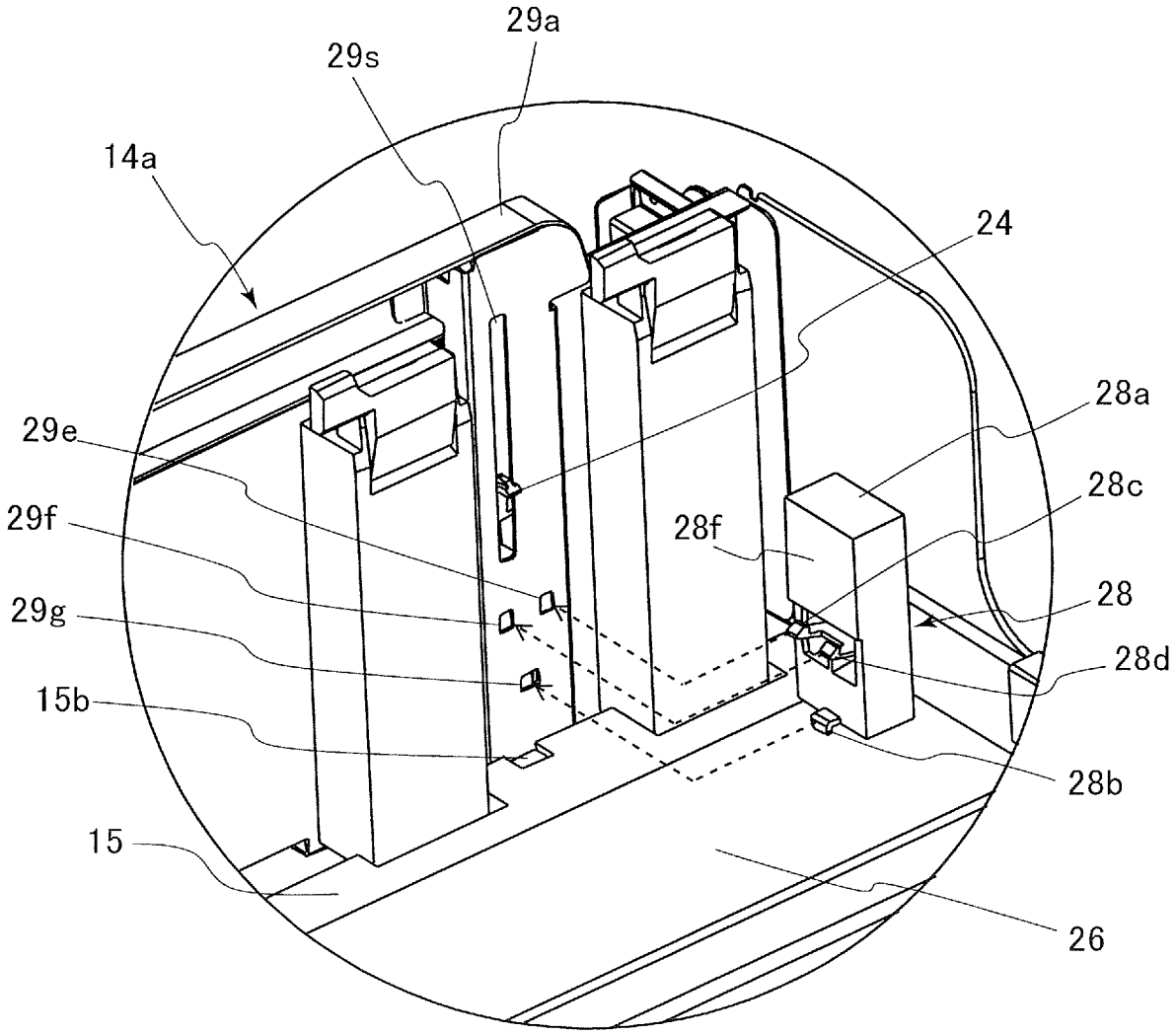
FIG. 12 is an illustration for explaining a shape of a fixing member and attachment method according to the first embodiment.

FIG. 11 is a sectional view of the sheet feeding deck 14 at the cutting position illustrated in FIG. 10, and FIG. 12 is a view for explaining the mounting method of the fixing member 28. As illustrated in FIGS. 11 and 12, the fixing member 28 is a substantially rectangular parallelepiped member including an upper surface 28*a* that supports the tray detection flag 24 and an abutting surface 28*f* that abuts on the back frame 29*a* of the deck portion 14. As the fixing member 28 of the present embodiment, a resin molded product molded using a mold is used. However, for example, corrugated paper may be bent into a similar shape.

The fixing member 28 has a hook portion 28*b* and snap fits 28*c* and 28*d* that protrude from the abutting surface 28*f*, respectively, as engagement portions that engage with the frame of the deck portion 14*a*. The fixing member 28 is fixed to the back frame 29*a* by engaging the hook portion 28*b* and the snap fits 28*c* and 28*d* with square holes 29*e*, 29*f*, and 29*g* of the back frame 29*a*. Moreover, the fixing member 28 is easily detached from the back frame 29*a* by pressing a pressing portion 28*e* with a finger and releasing the snap fits 28*c* and 28*d* from the square holes 29*e* and 29*f*.

In a case where the fixing member 28 is mounted on the deck portion 14*a*, the tray detection flag 24 is supported on the upper surface 28*a* of the fixing member 28 in a state where the tray detection flag 24 is lifted upward from the lower end position of the slit 29*s*. That is, the tray detection flag 24 is held at a predetermined holding position where the projection portion 24*a* is separated from the tray position detection switch 25*a*. At this time, since the tray position detection switch 25*a* is not in contact with the projection portion 24*a*, the output signal of the tray position detection switch 25*a* is off. That is, when the fixing member 28 is mounted, the tray position detection switch 25*a* outputs the third signal indicating that the tray 15 is above the predetermined position in a state where the tray 15 is actually below the predetermined position.

In the packed state, the packing member 26 and the fixing member 28 are at positions separated downward from any of the sheet surface sensor 21, the sheet presence sensor 23, and the sheet feed unit 14*f*. That is, the packing member 26 and the fixing member 28 are separated downward from a detection position (position where sheet or tray 15 abuts on flag 20*a* of holder 20 and sheet surface sensor 21 is switched from off to on) of the sheet surface sensor 21. Moreover, the packing member 26 and the fixing member 28 are separated downward from the lower end of the range in which the pickup roller 6 moves when the holder 20 pivots vertically. Therefore, even in a case where the deck portion 14*a* is pulled out, the packing member 26 and the fixing member 28 are disposed so as not to come into contact with members such as the sheet surface sensor 21 and the pickup roller 6 supported on the casing side of the sheet feeding deck 14.

The fixing member 28 of the present embodiment is mounted on the back frame 29*a* (upstream wall surface in pulling direction X1) of the deck portion 14*a* as illustrated in FIG. 10. That is, the fixing member 28 is at a position where it can be easily seen when the user pulls out the deck portion 14*a*.

Control Method

Next, a control method for preventing forgetting to remove the packing member 26 in a case where the sheet feeding deck 14 in the packed state is delivered to the user and the power of the apparatus is turned on will be described with reference to the flowchart in FIG. 13. The present flowchart is started in a case where the power of the printer 1 is turned on. Moreover, processes of each process of the flowchart are achieved by the CPU 51 of the control unit 50 executing the control program.

When the power of the printer 1 is turned on, the CPU 51 checks whether or not the "tray position detection switch 25*a* is off" and the "sheet presence sensor 23 is on" (that is, whether or not first detection device and second detection device output second signal and third signal, respectively) (S1). In a case where both of these conditions are satisfied, the CPU 51 determines not to lift up the tray 15 (S2), and notifies the display 55 that there is no sheet in the sheet feeding deck 14 (S3). Upon receiving the notification, the display 55 displays on the screen information indicating that there is no sheet in the sheet feeding deck 14 and notifies the user that there is no sheet.

Here, in a state where the packing member 26 and the fixing member 28 are mounted on the sheet feeding deck 14, the "tray position detection switch 25*a* is off" and the "sheet presence sensor 23 is on" when the power is turned on. That is, since the tray detection flag 24 is lifted by the fixing member 28, the output signal of the tray position detection switch 25*a* is off. Moreover, since the packing member 26 is in a position where it does not come into contact with the sheet detection lever 22, the output signal of the sheet presence sensor 23 is on (non-shielded state). Therefore, if the packing member 26 and the fixing member 28 are mounted when the power is turned on, the lift-up of the tray 15 is regulated, and information indicating that there is no sheet in the sheet feeding deck 14 is displayed on the display 55.

When a user who received information from the display 55 opens the deck portion 14*a* in order to replenish sheets, the user will see that the packing member 26, the tape 27, and the fixing member 28 are mounted in the deck. When the user removes the packing member 26, the tape 27, and the fixing member 28, the tray detection flag 24 falls due to its own weight and stops at the lower end position of the slit 29*s*, and the projection portion 24*a* comes into contact with the tray position detection switch 25*a*. Therefore, if the user closes the deck portion 14*a* with the packing member or the like properly removed, the tray position detection switch 25*a* changes from off to on. After checking that the tray position detection switch 25*a* is changed from off to on after the notification in S3 (S4), the CPU 51 determines that the lift-up of the tray 15 can be executed based on the remaining amount of the sheet and the process proceeds to S5 to S10.

It is noted that even in a case where the packing member 26 and the like are already removed, if the tray 15 is above the reference position when the power is turned on and no sheets are stacked on the tray 15, the condition of S1 is satisfied. Accordingly, the CPU 51 executes the processes of S2 to S4 as in the case where the packing member 26 is mounted. In this case, when the user opens the deck portion 14*a* according to the display on the display 55, the tray 15 falls below the reference position. After that, when the deck portion 14*a* is closed, the tray position detection switch 25*a* is in the on state, so the CPU 51 determines that the tray 15 can be lifted up. Even if the packing member 26 is already removed, the lift-up of the tray 15 is regulated because the frequency of occurrence of the situation "the tray 15 is above the reference position when the power is turned on and no sheets are stacked on the tray 15" is low after the removal of the packing member 26. That is, while the power is maintained in the on state, the lift-up state of the tray 15 is maintained so that the uppermost sheet is within the detection range of the sheet presence sensor 23 by the processes of S5 to S10 described later. Moreover, when the deck portion 14*a* is opened, the tray 15 is disconnected from the tray lifting motor M2 that is a drive source and falls below the reference position. Therefore, the above situation occurs after the removal of the packing member 26, for example, when the power is turned off during the lifting operation of the tray 15 and then the power is turned on again without opening or closing the deck portion 14*a*.

On the other hand, in a case where the condition of S1 is not satisfied, that is, in a case where "the tray position detection switch 25*a* is on" or "the signal of the sheet presence sensor 23 is off" when the power is turned on, the CPU 51 determines that it is not necessary to execute processes of S2 to S4 and proceeds to the processes of S5 to S10. Here, if the fixing member 28 is mounted, the tray position detection switch 25*a* is normally not on. Therefore, if "the tray position detection switch 25*a* is on" when the power is turned on, it can be determined that the fixing member 28 is already removed. Moreover, if "the signal of the sheet presence sensor 23 is off (shielded state)", when the power is turned on, it can be determined that the sheets are stacked up to the height of the sheet detection lever 22. Therefore, in these cases, it can be determined that the packing member or the like is already removed, and the CPU 51 can determine that it is not necessary to execute the processes of S2 to S4.

In S5 to S10, the tray 15 is raised and lowered so that the position of the uppermost sheet is maintained within a range where the feeding operation by the sheet feed unit 14*f* can be performed. That is, in a case where the sheet surface sensor 21 is on (S5: No), that is, in a case where there is no uppermost sheet at the feed position, the tray 15 is lifted up until the sheet surface sensor 21 changes from on to off (until output of third detection device changes from sixth signal to fifth signal) (S6). When the sheet surface sensor 21 is off (S5: Yes), the presence or absence of the sheet is checked by the sheet presence sensor 23 (S7). In a case where the sheet presence sensor 23 is off, that is, in a case where there is a sheet on the tray, it is determined that the feeding operation can be performed. That is, when the user instructs the printer 1 to execute image forming operation, the sheet feed unit 14*f* is driven by the sheet feeding motor M1, and the sheets are fed one by one (S8). Thereafter, when the sheet is fed, the position of the uppermost sheet is lowered, and when the sheet surface sensor 21 changes from off to on, the lift-up is performed again (S6).

On the other hand, in the case where the sheet presence sensor 23 is on in S7, that is, in the case where the sheet presence sensor 23 does not detect a sheet even if the tray 15 is raised up to the feed position, it is determined that the feeding operation cannot be executed because there is no sheet on the tray. In this case, the CPU 51 determines not to lift up the tray 15 (S9), and notifies the user that there is no sheet in the sheet feeding deck 14 via the display 55 (S10). Thereafter, when it is detected that the sheet feeding deck 14 is closed after being opened (S11: Yes), the process returns to S5 and is repeated.

SUMMARY OF THIS EMBODIMENT

As described above, in the present embodiment, in the packed state in which the tray 15 is below the reference position, the state of the tray position detection unit 35 is regulated using the fixing member 28 so that an off signal (third signal) indicating that the tray 15 is above the predetermined position is output. Then, based on the output signals of the tray position detection unit 35 and the sheet presence sensor 23 when the power of the printer 1 is turned on, it is determined whether or not the tray 15 can be lifted up (S1 in FIG. 13). In doing so, in a case where the sheet presence sensor 23 does not detect a sheet and the tray position detection unit 35 outputs an off signal, the lift-up of the tray 15 is restricted. In other words, when the power of the sheet feeding apparatus is turned on, in a case where the first detection device outputs the second signal indicating that no sheet is detected and the second detection device outputs the third signal, the movement of the stacking member by the lifting unit is restricted.

Accordingly, even if the power of the printer 1 is turned on while the packing member 26 is mounted on the sheet feeding deck 14, the lift-up of the tray 15 is restricted. Therefore, damage to the components inside the deck, which is a concern in a case where the tray 15 is lifted up while the packing member 26 is still mounted, can be prevented. Moreover, in the present embodiment, since information indicating that there is no sheet in the sheet feeding deck 14 is displayed on the display 55, the user can be guided to open the deck portion 14*a* and remove the packing member and the like.

Here, instead of the method of regulating the state of the tray position detection unit 35 by the fixing member 28, it is possible to regulate the state of the sheet surface sensor 21 by extending a part of the packing member upward. In this case, if the holder 20 is lifted by the packing member to shield the sheet surface sensor 21 and not to shield the sheet presence sensor 23, the CPU 51 can be directed to determine that there is no sheet in the tray 15. However, in this configuration, the packing member may scratch the holder 20 and the sheet surface sensor 21 due to the vibration during transportation, which may affect the conveyance of the sheet. Moreover, if a part of packing member is present in the vicinity of the sheet feed unit 14*f*, when the deck portion 14*a* is pulled out, there is a high possibility that the sheet feed unit 14*f* supported by the casing of the sheet feeding deck 14 and the packing member interfere with each other, and the member may be damaged.

On the other hand, in the present embodiment, since the packing member 26 and the fixing member 28 are disposed at positions separated downward from the sheet feed unit 14*f* and the sheet surface sensor 21, such inconvenience is avoided. Moreover, the packing member 26 and the fixing member 28 of the present embodiment do not need to extend upward to the vicinity of the sheet feed unit 14*f* as long as the tray 15 can be fixed below the reference position and the tray detection flag 24 can be fixed in a state of being separated from the tray position detection switch 25*a*. Therefore, the packing member 26 and the fixing member 28 can be downsized and simplified, which contributes to cost reduction. It is noted that even if the fixing member 28 comes into contact with the tray detection flag 24 due to vibration during transportation, at least, the possibility of influencing the sheet conveyance is reduced as compared with the case where the sheet detection lever 22 and the holder 20 disposed in the vicinity of the sheet feed unit 14*f* are scratched.

Modification Examples

Figure 13:
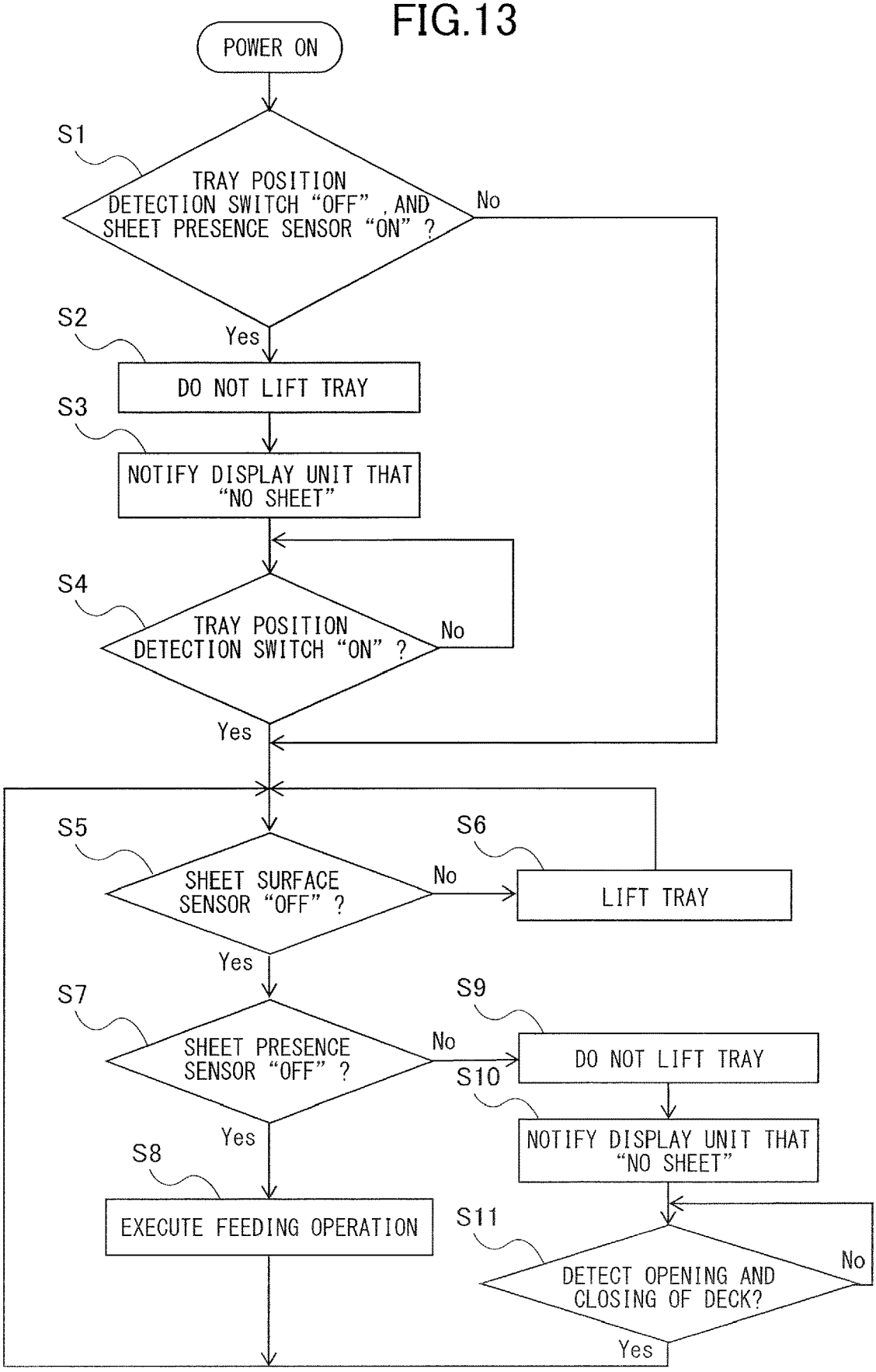
FIG. 13 is a flowchart illustrating a control method of the sheet feeding deck according to the first embodiment.

In the present embodiment, it has been described that information indicating that there is no sheet in the sheet feeding deck 14 is displayed on the display 55 in a case where "the tray position detection switch 25*a* is off" and "the sheet presence sensor 23 is on" when the power is turned on (S3 in FIG. 13). Instead, in a case where the same condition is satisfied when the power is turned on, information on removal of the packing member 26 may be displayed on the display 55.

In this case, it is preferable to store information indicating that the apparatus is in a new state in a nonvolatile storage device such as the NVRAM 54 at the time of factory shipment and display the above-described information on the packing member 26 on the display 55 only in the case where the information can be checked when the power is turned on. This is to prevent the user from being confused by displaying information prompting the user to remove the packing member 26 even though the packing member 26 is already removed in a case where the power of the printer 1 is temporarily turned off and then on again. That is, a case where the printer 1 is turned on and off in a state where the tray 15 is above the reference position and the sheet presence sensor 23 does not detect a sheet when the packing member 26 and the fixing member 28 are already removed can be considered. At this time, if the control method of the present embodiment is applied as it is, the determination result of S1 in FIG. 13 becomes Yes, and information of removal of the packing member 26 is displayed on the display 55. On the other hand, in addition to the condition of S1 in FIG. 13, if it is configured to display information on the packing member only in a case where it is confirmed that the apparatus is in a new state, such inconvenience is avoided. It is noted that in a case where the tray position detection switch 25*a* is on even once, the information indicating that the apparatus is in the new state stored in the NVRAM 54 is rewritten.

Moreover, in the present embodiment, the tray position detection unit 35 which is the second detection device is described as a device that detects whether or not the tray 15 is above the reference position in order to obtain the remaining amount of sheet. However, the second detection device may use a sensor disposed for other purposes. For example, a sensor may be used that regulates the tray 15 from being lowered to the bottom portion of the deck portion in a case where the deck portion 14*a* is opened to stop the tray 15 at a certain position between the feed position and the bottom portion of the deck portion. By stopping the tray 15 at such an intermediate position, the sheet can be easily exchanged, and the lifting operation after the deck portion 14*a* is closed can be shortened to improve the FCOT. FCOT is an abbreviation of First Copy Output Time, and in here, it indicates the time required from when the deck portion 14*a* is closed until the first product is output from the printer 1 using the sheet fed from the sheet feeding deck 14.

Second Embodiment

Next, the configuration of a sheet feeding apparatus according to a second embodiment will be described with reference to FIGS. 14 and 15. The present embodiment is different from the first embodiment in that a tape member is used as the regulation member. Other elements having the same configuration and function as those of the first embodiment are denoted by the same reference numeral as those of the first embodiment, and the description thereof is omitted.

Figure 14:
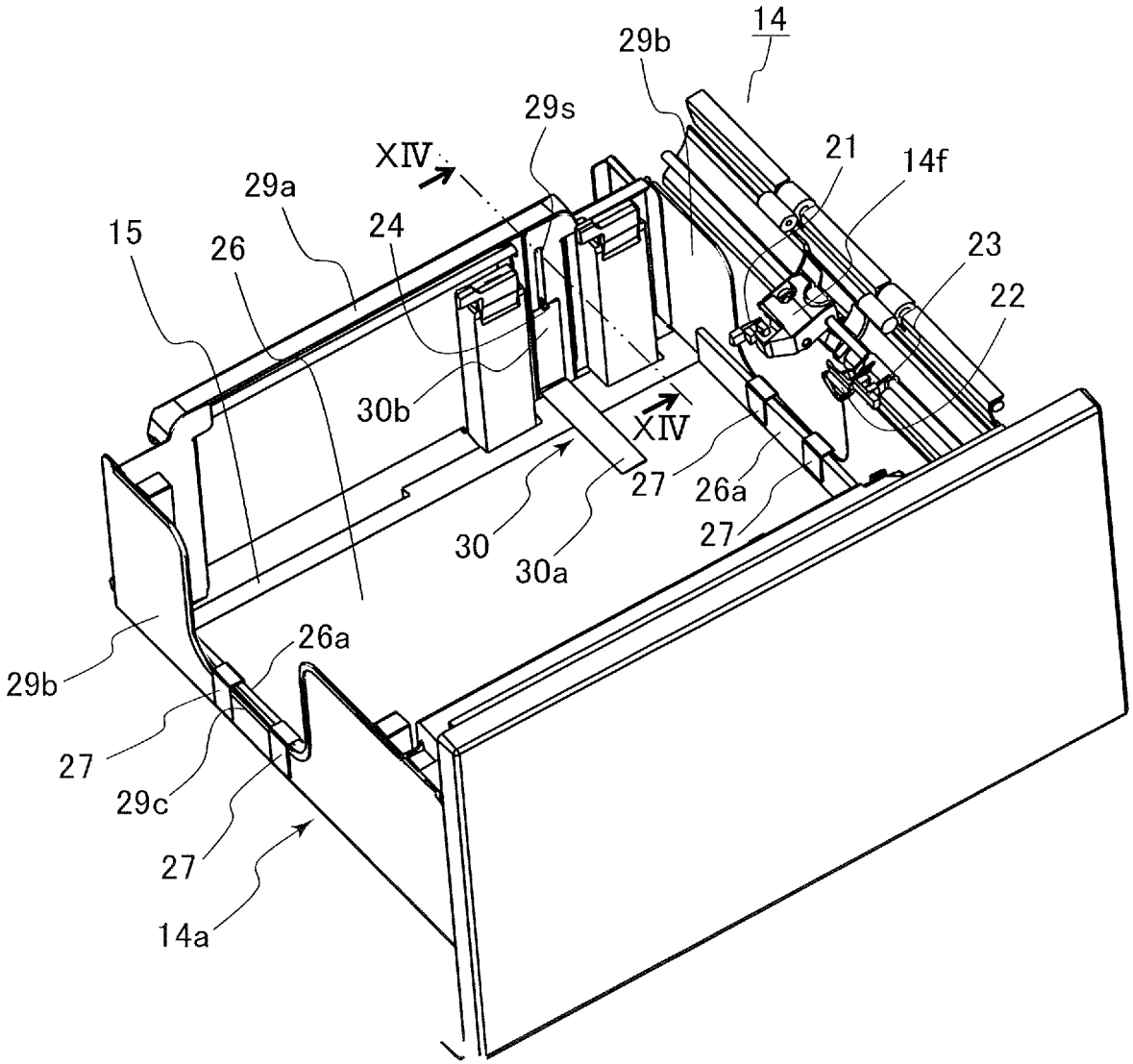
FIG. 14 is a perspective view illustrating a state in which a packing member is mounted on a sheet feeding deck according to a second embodiment.

FIG. 14 is a perspective view illustrating the deck portion 14*a* of the sheet feeding deck 14 of the present embodiment. A fixing tape 30, which is a regulation member of the present embodiment is bonded to the packing member 26 at a lower end portion 30*a*, is bent in an L shape so as to extend upward along the back frame 29*a* of the deck portion 14*a*, and is sticking on the back frame 29*a* at an upper end portion 30*b*.

Figure 15:
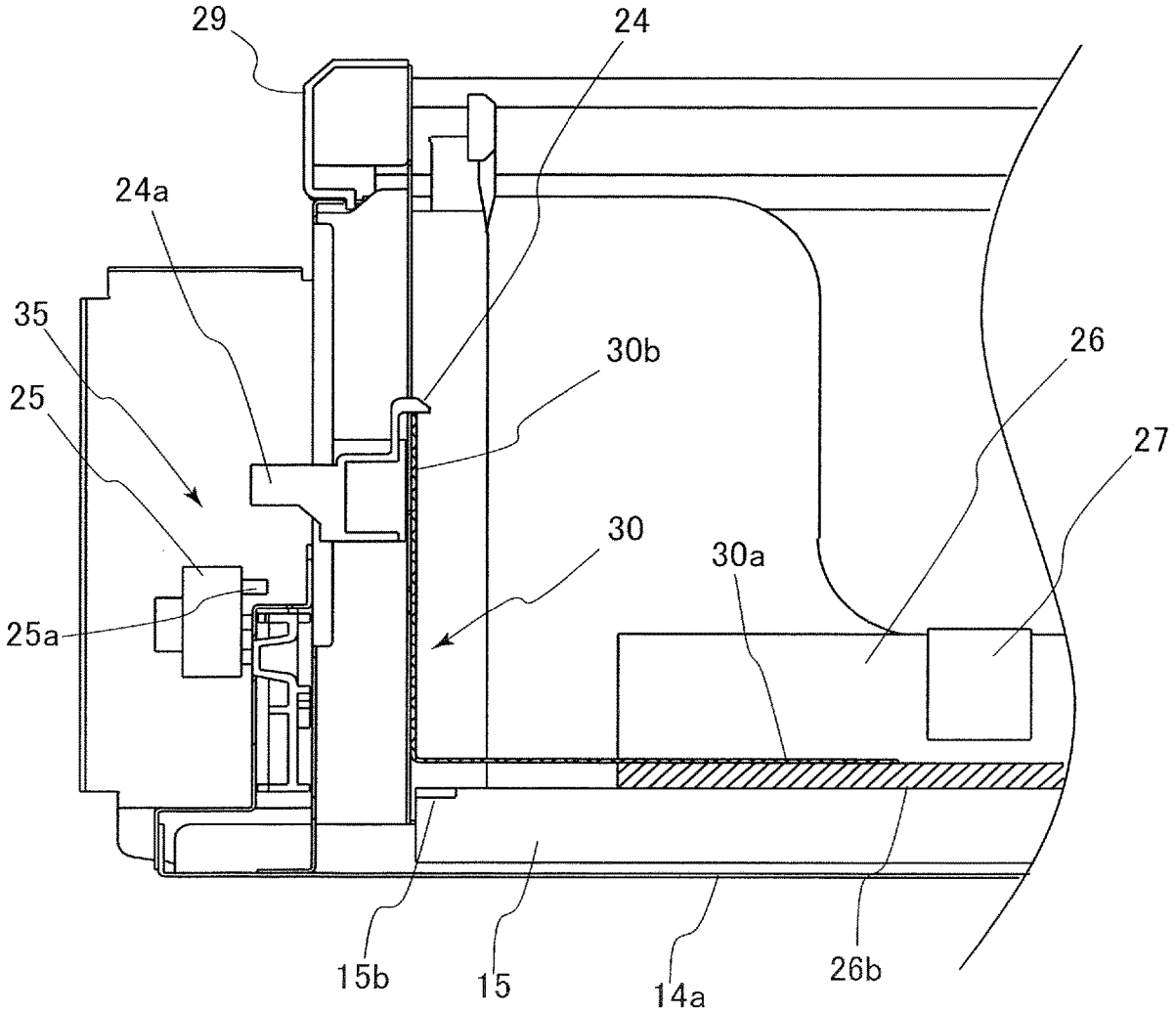
FIG. 15 is a sectional view of the sheet feeding deck at the cutting position illustrated in FIG. 14.

FIG. 15 is a sectional view of the sheet feeding deck 14 at the cutting position illustrated in FIG. 14. The fixing tape 30 abuts on the tray detection flag 24 at the upper end portion 30*b*, and holds the tray detection flag 24 at a position where the projection portion 24*a* is separated upward from the tray position detection switch 25*a*. At this time, since the projection portion 24*a* of the tray detection flag 24 is separated from the tray position detection switch 25*a*, the tray position detection switch 25*a* is in an off state. That is, when the fixing tape 30 is attached, the tray position detection switch 25*a* outputs the third signal indicating that the tray 15 is above the predetermined position in a state where the tray 15 is actually below the predetermined position.

The control method when the power of the printer 1 is turned on is the same as in the first embodiment. That is, if the power is turned on with the fixing tape 30 attached, since "the tray position detection switch 25*a* is off" and "the sheet presence sensor 23 is on", the CPU 51 does not perform the lifting operation of the tray 15 (S2 in FIG. 13). Then, by displaying information notifying that there is no sheet in the sheet feeding deck 14 on the display 55, the user can open the deck portion 14*a* and recognize that the packing member 26 and the tape 27 remain mounted. Therefore, the same advantages as in the first embodiment can be obtained by the configuration of the present embodiment.

Moreover, the fixing tape 30 of the present embodiment does not require a mold as in the first embodiment, and a general-purpose tape can be used. Therefore, the cost and time required for components procurement can be reduced. Moreover, since a first end of the fixing tape 30 is bonded to the packing member 26, the fixing tape 30 is removed from the sheet feeding deck 14 with the packing member 26 by removing the packing member 26. Accordingly, the startup procedure when installing the printer 1 is simplified, so that usability can be improved.

Third Embodiment

Next, the configuration of a sheet feeding apparatus according to a third embodiment will be described with reference to FIGS. 16 to 18. The present embodiment is different from the first embodiment in that the regulation member and the packing member are formed as an integral member. Other elements having the same configuration and operation as those of the first embodiment are denoted by the same reference numeral as those of the first embodiment, and the description thereof is omitted.

Figure 16:
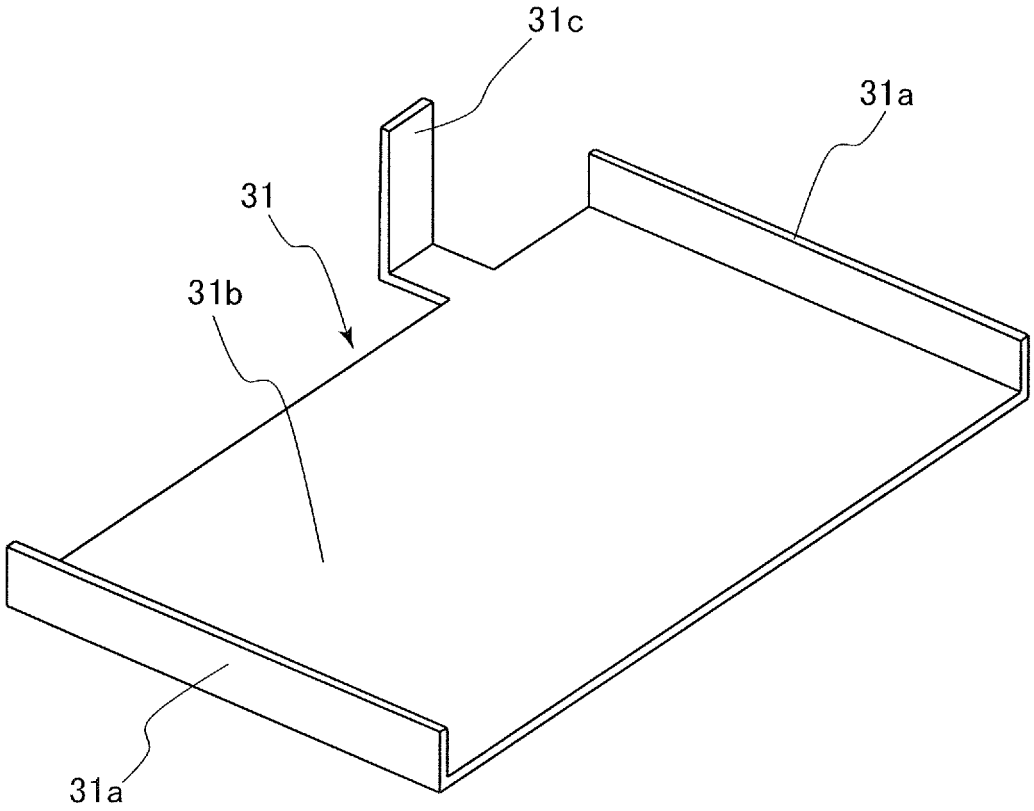
FIG. 16 is a perspective view of a packing member according to a third embodiment.

FIG. 16 is a perspective view illustrating a packing member 31 of the present embodiment. In the packing member 31, the shape of a bottom portion 31*b* and side portions 31*a* and 31*a* are the same as the bottom portion 26*b* and the side portions 26*a* and 26*a* of the packing member 26 of the first embodiment. In addition, the packing member 31 has a fixing portion 31*c* that protrudes from one side of the bottom portion 31*b* and is bent in an L shape so as to extend upward.

Figure 17:
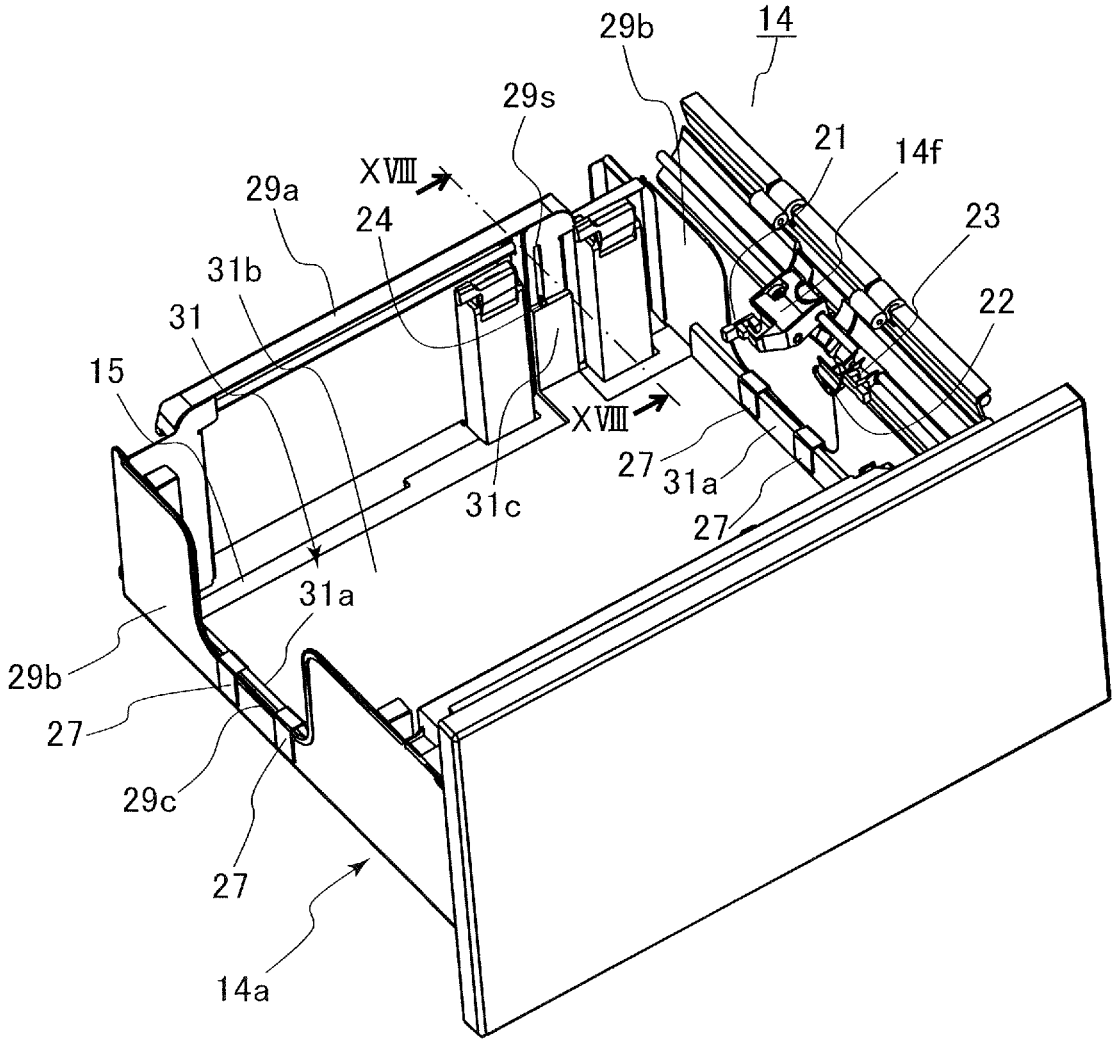
FIG. 17 is a perspective view illustrating a state in which the packing member is mounted on a sheet feeding deck according to the third embodiment.
Figure 18:
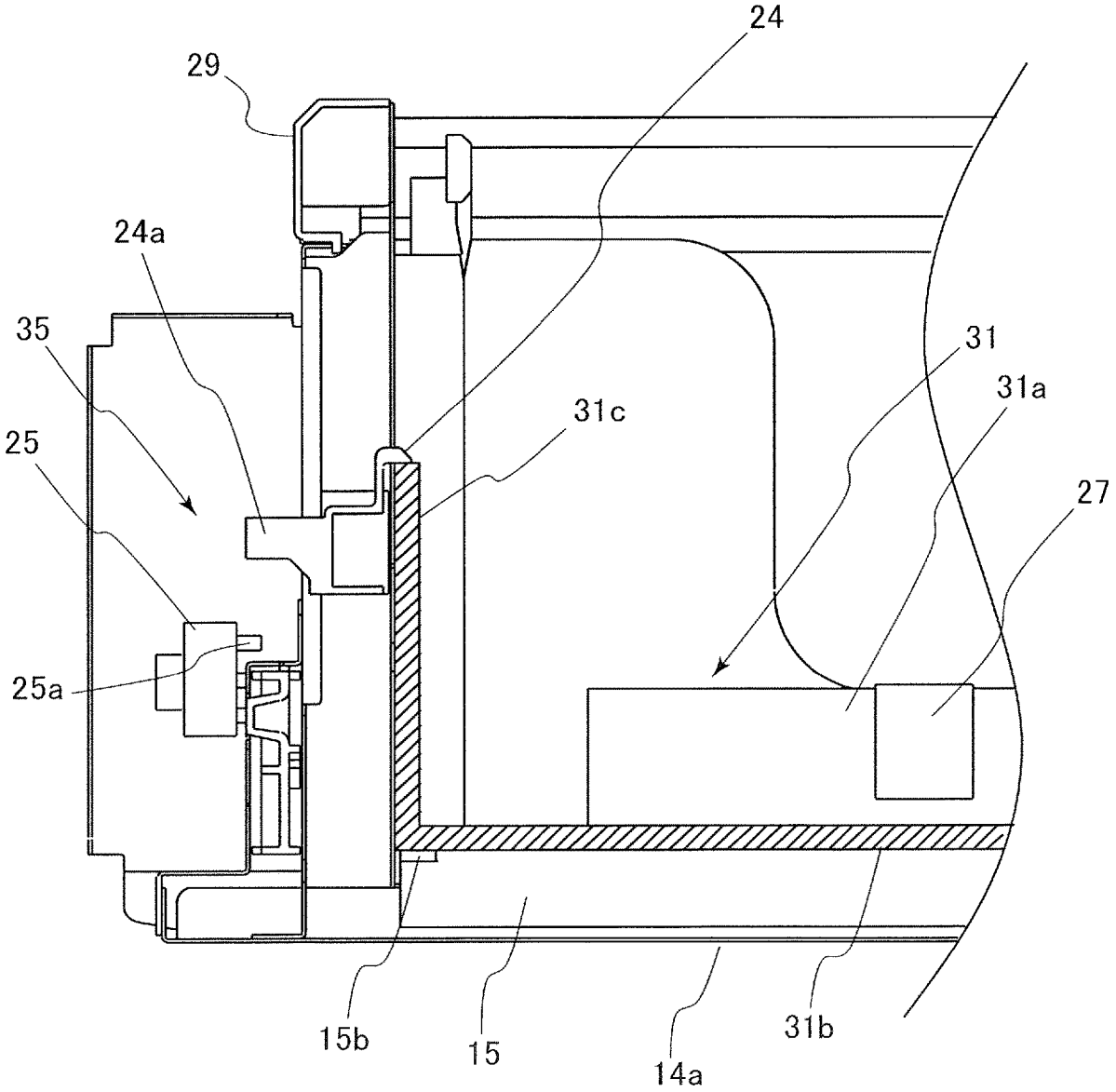
FIG. 18 is a sectional view of the sheet feeding deck at the cutting position illustrated in FIG. 17.

FIG. 17 is a perspective view of the deck portion 14*a* on which the packing member 31 is mounted, and FIG. 18 is a sectional view of the sheet feeding deck 14 at the cutting position illustrated in FIG. 17. As illustrated in FIGS. 17 and 18, the fixing portion 31*c* extends upward along the back frame 29*a* of the deck portion 14*a*. The fixing portion 31*c* abuts on the tray detection flag 24 at the upper end portion, and holds the tray detection flag 24 at the position where the projection portion 24*a* is separated upward from the tray position detection switch 25*a*. In this case, since the projection portion 24*a* of the tray detection flag 24 is separated from the tray position detection switch 25*a*, the tray position detection switch 25*a* is in an off state. That is, when the fixing portion 31*c* of the packing member 31 is mounted, the tray position detection switch 25*a* outputs the third signal indicating that the tray 15 is above the predetermined position in a state where the tray 15 is actually below the predetermined position.

The control method when the power of the printer 1 is turned on is the same as in the first embodiment. That is, if the power is turned on in the state where the fixing portion 31*c* of the packing member 31 is mounted, since "the tray position detection switch 25*a* is off" and "the sheet presence sensor 23 is on", the CPU 51 does not perform the lifting operation of the tray 15 (S2 in FIG. 13). Then, by displaying information notifying that there is no sheet in the sheet feeding deck 14 on the display 55, the user can open the deck portion 14*a* and recognize that the packing member 31 and the tape 27 remain mounted. Therefore, the same advantages as in the first embodiment can be obtained by the configuration of the present embodiment.

Moreover, since the fixing portion 31*c* of the present embodiment is formed as a part of the packing member 31, the number of components can be reduced to reduce the manufacturing cost and improve the workability at the time of packing.

Modified Embodiments

In the first to third embodiments, the configuration in which the control unit 50 mounted in the printer body 1A controls the operation of the sheet feeding deck 14 connected to the printer body 1A is exemplified. That is, the sheet feeding apparatus of the above-described embodiment includes the sheet feeding deck 14 and the control unit 50 which is a control unit mounted on the printer body 1A. However, a control unit that controls the operation of the sheet feeding apparatus may be disposed independently from the control unit that controls the operation of the image forming apparatus body inside the sheet feeding apparatus connected to the image forming apparatus body. Moreover, the configurations described using the first to third embodiments can be applied to a sheet feeding apparatus (for example, sheet feeding unit 5 of the above-described embodiment) assembled in the image forming apparatus body.

As long as the second detection device that detects the position of the stacking member regulates the state of the second detection device so that a predetermined signal is output, a regulation member that uses a method other than a method of physically fixing a part of the second detection device may be used. For example, in the case where a photoelectric sensor is used as the second detection device, by forming a part of the regulation member to shield the photosensing portion of the sensor, it is possible to output an off signal from the sensor regardless of the position of the stacking member when the regulation member is mounted.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-214208, filed on Nov. 14, 2018, which is hereby incorporated by reference herein in its entirety.

What is claimed is:

1. A sheet feeding apparatus comprising:

a storage portion configured to store a sheet and comprising a stacking member on which the sheet is stacked;

a sheet feeding unit disposed above the stacking member and configured to feed the sheet stacked on the stacking member;

a lifting unit configured to lift the stacking member;

a moving member configured to move along with the stacking member, a first detection device configured to output a first signal upon detecting the sheet stacked on the stacking member and to output a second signal upon detecting no sheet;

a second detection device configured to output a third signal in a case where the stacking member is above a predetermined position and to output a fourth signal in a case where the stacking member is below the predetermined position, the predetermined position being lower than a position at which the sheet feeding unit abuts on the sheet stacked on the stacking member;

a packing member detachably attached to the storage portion;

a regulation member configured to regulate a state of the second detection device such that the second detection device outputs the third signal in a state in which the stacking member is below the predetermined position, the regulation member being configured to be removed from the sheet feeding apparatus in a case where the packing member is detached; and a control unit configured to control movement of the stacking member by the lifting unit, the control unit being configured to restrict the movement of the stacking member in a case where the first detection device outputs the second signal and the second detection device outputs the third signal when power of the sheet feeding apparatus is turned on, wherein the second detection device comprises a switch that emits the third signal while abutting the moving member and emits the fourth signal while being separated from the moving member, and wherein the moving member is configured to be separated from the switch in a case where the stacking member is above the predetermined position and to abut against the switch in a case where the stacking member is below the predetermined position.

2. The sheet feeding apparatus according to claim 1, further comprising a display unit configured to display information, wherein the control unit is configured to operate the display unit to display information indicating that no sheet is stacked on the stacking member in a case where the first detection device outputs the second signal and the second detection device outputs the third signal when the power of the sheet feeding apparatus is turned on.

3. The sheet feeding apparatus according to claim 1, further comprising a display unit configured to display information, wherein the control unit is configured to operate the display unit to display information on removal of the packing member in a case where the first detection device outputs the second signal and the second detection device outputs the third signal when the power of the sheet feeding apparatus is turned on.

4. The sheet feeding apparatus according to claim 1, wherein the control unit is configured to operate the lifting unit to lift the stacking member, in a case where the first detection device outputs the second signal and the second detection device outputs the third signal when the power of the sheet feeding apparatus is turned on and the output of the second detection device is changed from the third signal to the fourth signal after the power is turned on.

5. The sheet feeding apparatus according to claim 4, further comprising:

a third detection device configured to output a fifth signal in a state in which either the sheet or the stacking member is at a feed position and to output a sixth signal in a state in which neither the sheet nor the stacking member is at the feed position, the feed position being a position at which the sheet feeding unit abuts on the sheet stacked on the stacking member; and a drive source configured to drive the lifting unit based on a command of the control unit, wherein the control unit is configured to determine, after starting to lift the stacking member, an amount of the sheet stacked on the stacking member based on a drive amount of the drive source since the output of the second detection device has been changed from the fourth signal to the third signal until the output of the third detection device is changed from the sixth signal to the fifth signal.

6. The sheet feeding apparatus according to claim 1, wherein the control unit is configured to operate the lifting unit to lift the stacking member up to a feed position at which the sheet feeding unit abuts on the sheet stacked on the stacking member in a case where the second detection device outputs the fourth signal when the power of the sheet feeding apparatus is turned on.

7. The sheet feeding apparatus according to claim 6, further comprising:

a third detection device configured to output a fifth signal in a state in which the sheet or the stacking member is at the feed position and outputs a sixth signal in a state in which neither the sheet nor the stacking member is at the feed position; and a display unit configured to display information, wherein the control unit is configured to operate the lifting unit to lift the stacking member until the output of the third detection device is changed from the sixth signal to the fifth signal in a case where the second detection device outputs the fourth signal when the power of the sheet feeding apparatus is turned on, and to operate the display unit to display information indicating that no sheet is stacked on the stacking member in a case where the first detection device outputs the second signal when the output of the third detection device is changed from the sixth signal to the fifth signal.

8. The sheet feeding apparatus according to claim 1, further comprising:

an apparatus body into which the storage portion is drawably inserted; and a holding member configured to hold the sheet feeding unit, supported by the apparatus body, and movable in a vertical direction, wherein the packing member and the regulation member are separated downward from a lower end of a range in which the sheet feeding unit moves when the holding member moves.

9. The sheet feeding apparatus according to claim 1, wherein the regulation member is configured to fix the moving member at a position separated from the switch in a state where the stacking member is below the predetermined position.

10. The sheet feeding apparatus according to claim 1, wherein the regulation member is a tape sticking on the storage portion.

11. The sheet feeding apparatus according to claim 1, wherein the regulation member is attached to the packing member, and is removed from the sheet feeding apparatus together with the packing member by removing the packing member from the storage portion.

12. The sheet feeding apparatus according to claim 1, wherein the regulation member and the packing member are integrated as one member.

13. The sheet feeding apparatus according to claim 12, wherein the one member is made of a corrugated paper.

14. The sheet feeding apparatus according to claim 1, wherein the regulation member is attached to the storage portion in a state of being removable independently from the packing member.

15. The sheet feeding apparatus according to claim 1, wherein the packing member is configured to restrict movement of the stacking member in a state in which the lifting unit is stopped.

16. The sheet feeding apparatus according to claim 1, wherein the first detection device comprises a photoelectric sensor comprising a light emitting portion that emits light and a photosensing portion which emits the first signal in a case where the light emitted by the light emitting portion is not detected and emits the second signal in a case where the light emitted by the light emitting portion is detected, and wherein the sheet feeding apparatus further comprises a first moving member provided above the stacking member and configured to be pressed by the sheet and moved to a shielding position, at which the first moving member shields the photosensing portion from the light emitted from the light emitting portion, in a case where the stacking member is lifted with the sheet stacked on the stacking member and remains below the shielding position in a case where the stacking member is lifted with no sheet stacked on the stacking member.

17. An image forming apparatus comprising:

the sheet feeding apparatus according to claim 1, and an image forming unit configured to form an image on the sheet fed from the sheet feeding apparatus.

18. A sheet feeding apparatus comprising:

a storage portion configured to store a sheet and comprising a stacking member on which the sheet is stacked;

a sheet feeding unit disposed above the stacking member and configured to feed the sheet stacked on the stacking member;

a lifting unit configured to lift the stacking member;

a first detection device configured to output a first signal upon detecting the sheet stacked on the stacking member and to output a second signal upon detecting no sheet;

a second detection device configured to output a third signal in a case where the stacking member is above a predetermined position and to output a fourth signal in a case where the stacking member is below the predetermined position, the predetermined position being lower than a position at which the sheet feeding unit abuts on the sheet stacked on the stacking member;

a packing member detachably attached to the storage portion;

a regulation member configured to regulate a state of the second detection device such that the second detection device outputs the third signal in a state in which the stacking member is below the predetermined position, the regulation member being configured to be removed from the sheet feeding apparatus in a case where the packing member is detached, the regulation member being a tape sticking on the storage portion; and a control unit configured to control movement of the stacking member by the lifting unit, the control unit being configured to restrict the movement of the stacking member in a case where the first detection device outputs the second signal and the second detection device outputs the third signal when power of the sheet feeding apparatus is turned on.

19. The sheet feeding apparatus according to claim 18, wherein the control unit is configured to operate the lifting unit to lift the stacking member, in a case where the first detection device outputs the second signal and the second detection device outputs the third signal when the power of the sheet feeding apparatus is turned on and the output of the second detection device is changed from the third signal to the fourth signal after the power is turned on.

20. An image forming apparatus comprising:

the sheet feeding apparatus according to claim 18, and an image forming unit configured to form an image on the sheet fed from the sheet feeding apparatus.

* * * * *